US007368004B2

(12) United States Patent
Yamada et al.

(10) Patent No.: US 7,368,004 B2
(45) Date of Patent: May 6, 2008

(54) ELECTRIC DUST COLLECTOR

(75) Inventors: Tetsuyoshi Yamada, Aichi (JP); Toru Kai, Aichi (JP); Hiromu Iwahashi, Nara (JP); Naoyoshi Kurosaki, Aichi (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 274 days.

(21) Appl. No.: 10/562,665

(22) PCT Filed: Jul. 2, 2004

(86) PCT No.: PCT/JP2004/009768

§ 371 (c)(1),
(2), (4) Date: Dec. 28, 2005

(87) PCT Pub. No.: WO2005/002412

PCT Pub. Date: Jan. 13, 2005

(65) Prior Publication Data

US 2006/0150815 A1 Jul. 13, 2006

(30) Foreign Application Priority Data

| | | |
|---|---|---|
| Jul. 3, 2003 | (JP) | 2003-190949 |
| Jul. 3, 2003 | (JP) | 2003-190950 |
| Jul. 7, 2003 | (JP) | 2003-192668 |
| Dec. 15, 2003 | (JP) | 2003-416225 |
| Dec. 17, 2003 | (JP) | 2003-419191 |

(51) Int. Cl.
*B03C 3/155* (2006.01)

(52) U.S. Cl. ..... 96/55; 96/62; 96/64; 96/83; 96/88; 96/97

(58) Field of Classification Search ..... 96/55, 96/59–64, 83, 88, 96, 97
See application file for complete search history.

(56) References Cited

U.S. PATENT DOCUMENTS 4,976,753 A * 12/1990 Huang ..... 96/58

(Continued)

FOREIGN PATENT DOCUMENTS

JP 03-188959 A 8/1991

(Continued)

OTHER PUBLICATIONS

International Search Report for PCT/JP2004/009768, dated Dec. 14, 2004.

*Primary Examiner*—Richard L Chiesa
(74) *Attorney, Agent, or Firm*—RatnerPrestia

(57) ABSTRACT

The electric dust collector has an oblong holding unit provided on the air channel of an air conditioner or the like; a high-voltage applying device provided at an end of the holding unit; a front-open contact protector of substantially inverted U-shape that contains a high-voltage power feeding terminal connected to the high-voltage applying device; a filter unit attached to the holding unit; and a slide projection provided on the filter unit. The slide projection has a high-voltage power receiving terminal removably fitted into the contact protector, allowing the filter unit to be removably attached to the holding unit. The high-voltage power feeding terminal covered with the contact protector is free from dust collection. The structure can prevent contact failure or electrical leak.

10 Claims, 37 Drawing Sheets

U.S. PATENT DOCUMENTS

| | | | | | |
|---|---|---|---|---|---|
| 5,060,717 | A | * | 10/1991 | Morita et al. | 165/53 |
| 5,092,396 | A | * | 3/1992 | Murano et al. | 165/119 |
| 5,290,343 | A | * | 3/1994 | Morita et al. | 96/39 |
| 5,330,559 | A | * | 7/1994 | Cheney et al. | 95/63 |
| 5,614,002 | A | * | 3/1997 | Chen | 96/55 |
| 5,622,543 | A | * | 4/1997 | Yang | 96/58 |
| 5,759,239 | A | * | 6/1998 | Yu | 96/3 |
| 5,807,425 | A | * | 9/1998 | Gibbs | 96/66 |
| 5,820,660 | A | * | 10/1998 | Ko | 96/30 |
| 6,164,082 | A | * | 12/2000 | Okamoto et al. | 62/317 |
| 2003/0005824 | A1 | * | 1/2003 | Katou et al. | 96/35 |

FOREIGN PATENT DOCUMENTS

| | | | | | |
|---|---|---|---|---|---|
| JP | 04-104847 | A | | 4/1992 | |
| JP | 4-171064 | A | * | 6/1992 | 96/96 |
| JP | 4-363157 | A | * | 12/1992 | 96/96 |
| JP | 10-099718 | A | | 4/1998 | |
| JP | 2856580 | | | 11/1998 | |
| JP | 2000-140694 | A | | 5/2000 | |
| JP | 2003-010731 | | | 1/2003 | |
| JP | 2003-103196 | | | 4/2003 | |
| JP | 2003-106552 | A | | 4/2003 | |

* cited by examiner

ELECTRIC DUST COLLECTOR

THIS APPLICATION IS A U.S. NATIONAL PHASE APPLICATION OF PCT INTERNATIONAL APPLICATION PCT/JP2004/009768, filed Jul. 2, 2004.

FIELD OF THE INVENTION

The present invention relates to an electric dust collector arranged in an air channel of an air conditioner to remove dust in air.

BACKGROUND OF THE INVENTION

Electric air purifiers arranged in air channels of conditioners are known.

A conventional electric air purifier disclosed in Japanese Patent Laid-Open Publication No. 2003-106552 will be described with reference to FIGS. 53 to 55. The air purifier includes holding frame 101, high-voltage power supply 102 provided at an end of holding frame 101, high-voltage terminal 103 and ground terminal 104 provided from high-voltage power supply 102, and removable filter body 106 having contact point 105 between high-voltage terminal 103 and ground terminal 104. Coil spring 107 or flat spring 108 is provided at least one of high-voltage terminal 103 and ground terminal 104. High-voltage power supply 102 is provided on holding frame 101 in a manner that each elastic tip of terminals 103 and 104 projects from partition wall 109 provided between high-voltage power supply 102 and a part through which filter body 106 is inserted.

Holding wall 110 provided at an end of holding frame 101 on the opposite side of high-voltage power supply 102 to hold filter body 106 fitted into holding frame 101. Filter body 106 is fixed between partition wall 109 and holding wall 110 in a manner that projection 111 provided on the side surface on the opposite side of contact point 105 has engagement with pit 112 provided on holding wall 110 of holding frame 101.

In the conventional air purifier, high-voltage terminal 103 connected to high-voltage power supply 102 easily collects dust, and the air purifier also has a part exposed from the structure.

Filter body 106 is, as described above, fixed between partition wall 109 and holding wall 110. When attached to or removed from the place, filter body 106 tends to have torsion due to the oblong shape, and therefore the installation work has often involved a difficulty.

Here will be described another electric dust collector having a synthetic resin-made holding frame, which is disclosed in Japanese Patent Unexamined Publication No. 2003-10731, with reference to FIGS. 56 to 58. Needle-shaped discharge electrode 1103 is provided on the side of water inlet 1102 of resin-made holding frame 1101, and then air-permeable ground electrode 1104 is provided so as to face discharge electrode 1103, furthermore, filter 1105 is located on the leeward side of ground electrode 1104. Filter unit 1106 is thus formed. When filter unit 1106 is mounted on the dust collector, high-voltage applying section 1107 applies negative high voltage to discharge electrode 1103, and ground electrode 1104 provides ground connection. Such formed high-voltage applying device 1108 is provided on the air channel in an air conditioner and the like.

In the conventional dust-collecting unit, holding frame 1101 is made of commonly used synthetic resin, which easily collects dust due to charged static electricity.

As another conventional electric dust-collecting unit, Japanese Patent Laid-Open Publication No. 2003-103196 discloses another electric dust collector. The dust collector includes, in addition to the device that applies high voltage to a dust collecting section, a sound-wave generator that enhances dust collection efficiency. The dust collector will be described with reference to FIG. 59. Dust-collecting unit 2101 contains housing 2102, discharge electrode 2103, counter-electrode 2104, and dust-collecting filter 2105. In addition, controller 2107 and switch 2108 are provided so that direct current power supply 2106 provided outside dust-collecting unit 2101 applies voltage to discharge electrode 2103 and counter-electrode 2104. Furthermore, the dust collector has sound-wave generator 2110 on side section 2109 of housing 2102, and sound-wave controller 2111 for controlling sound-wave generator 2110. With the structure above, sound wave is applied to a corona discharge area so as to enhance dust collection efficiency. Air flows in direction 2201.

In the conventional electric dust collector, direct current power supply 2106 for applying direct current to dust-collecting unit 2101, controller 2107, and switch 2108 are provided outside the dust collector. Sound-wave generator 2110 is provided on side section 2109 of housing 2102 of the dust-collecting unit and is controlled by sound-wave controller 2111. That is, direct current power supply 2106, controller 2107, switch 2108, sound-wave generator 2110, and sound-wave controller 2111 can suffer mutual noise interference. The installation of these components away from dust-collecting unit housing 2102 not only increases the wiring in length for connecting these components, but also complicates measures against dust collection on each component.

As still another electric dust collection unit, Japanese Patent No. 2856580 discloses an air purifier. Changing the shape of an elastic portion provided on a filter opens or closes a power circuit for a high-voltage power supply unit. The air purifier will be described with reference to FIGS. 60 and 61. The air purifier includes body 3102 having removable front panel 3101, removable pre-filter 3103 provided on body 3102, high-voltage ionizier 3104 for removing dust in the air passing through pre-filter 3103, elastic portion 3105 provided on pre-filter 3103, and detecting switch 3106 for detecting altered elastic portion 3105. Elastic portion 3105 provided at pre-filter 3103 bends by being pushed by front panel 3101 when pre-filter 3103 is mounted on body 3102. Detecting switch 3106 detects the deformation of elastic portion 3105. Detecting switch 3106 does not detect the deformation, a power supply to high-voltage ionizer 3104 is turned off.

In this conventional air purifier, elastic portion 3105 provided on pre-filter 3103 bends toward detecting switch 3106 by being pushed by front panel 3101 when front panel 3101 is fixed to the body. If front panel 3101, pre-filter 3103, and detecting switch 3106 have positional variations, detecting switch 3106 cannot be activated accurately.

Besides, exposed detecting switch 3106 easily collects dust, which can cause faulty connections.

As yet another electric dust-collecting unit, Japanese Patent Laid-Open Publication No. 2003-106552 discloses an electric air purifier for an air conditioner. The electric air purifier will be described with reference to FIG. 62. The air purifier includes holding frame 4101, high-voltage power supply 4102 provided at an end of holding frame 4101, high-voltage terminal 4103 and ground terminal 4104 provided from high-voltage power supply 4102, contact point

4105 of high-voltage terminal 4103 and ground terminal 4104, and filter body 4106 removably provided to holding frame 4101.

In this conventional electric air purifier, high-voltage power supply 4102 is provided on holding frame 4101, which is seen on the left side in the drawing, and filter body 4106 is fixed on the right side of high-voltage power supply 4102. Due to positional constraint in mounting on an air conditioner, high-voltage power supply 4102 cannot be provided on the right side of holding frame 4101.

High-voltage terminal 4103 and ground terminal 4104 are provided on only one side of the right and left sides of filter body 4106 to be mounted on holding frame 4101. Therefore, when filter body 4106 is removed from holding frame 4101, filter body 4106 tends to have torsion, due to resistance of high-voltage terminal 4103 and ground terminal 4104, so that the removing work has often involved a difficulty.

SUMMARY OF THE INVENTION

According to an aspect of the present invention, an electric dust collector includes an holding unit having an oblong shape provided in an air channel of an air conditioner, a high-voltage applying device provided at an end of the holding unit, a contact protector opening to front and having a cave shape facing substantially downward, a filter unit attached to the holding unit, and a slide projection provided at the filter unit. The contact protector accommodates a high-voltage power feeding terminal connected to the high-voltage applying device. The slide protection includes a high-voltage power receiving terminal removably fitted into the contact protector so that the filter unit is removably mounted on the holding unit.

This structure allows the high-voltage power feeding terminal to be covered with the contact protector, thus being prevented from having dust attached thereto. The structure not only prevents contact failure or electrical leak that is possibly caused by dust, but also protects hands or fingers from accidentally touching the high-voltage power feeding terminal, thereby increasing safety. The electric dust collector can provide a simple structure less expensive than the structure in which application of high voltage is controlled by a limit switch.

According to another aspect of the invention, the electric dust collector may include a guide rib provided on one of the holding unit and the high-voltage applying device so as to be parallel to a direction in which the filter unit is pulled out. A groove for accepting the guide rib is provided in the filter unit. The groove reaches substantially a center of the filter unit. This structure allows the filter unit to be smoothly removed without torsion, preventing the filter from being removed with torsion.

According to still another aspect of the invention, the electric dust collector may include a latching unit provided at an end of the filter unit opposite to an end at which the high-voltage power receiving terminal is provided. The filter unit is temporarily retained when the filter unit is pulled out.

In the structure above, the end having the high-voltage power receiving terminal of the filter unit attaches to the holding unit tighter than the other end of the filter unit. The latching unit causes the "looser" end to be temporarily held until the "tighter" end is removed first. The structure allows the filter unit to be smoothly removed without torsion.

According to yet another aspect of the invention, the electric dust collector may include a handle provided on the filter unit while biased to the high-voltage power receiving terminal. A pulling-out force caused by the handle is applied strongly to a portion of the filter unit to the high-voltage power receiving terminal. The portion of the filter unit is attached to the holding unit tighter than the opposite side, whereby the tighter end can be pulled out at almost simultaneously to the other side, encouraging a smooth pull-out of the filter unit.

According to another aspect of the invention, an electric dust collector includes an oblong holding unit mounted in an air channel of an air conditioner, a high-voltage applying device provided at an end of the holding unit, and a filter unit removably provided on the holding unit. The filter unit includes an air-intake grill having a shape having a center projecting to front. The air-intake grill has a first discharge needle electrically connected to the high-voltage applying device. The filter unit further includes an air-permeable ground electrode provided on a leeward side of the first discharge needle, and an air-permeable dust-collecting filter provided on a leeward side of the first discharge needle. The air-intake grill includes a non-conductive rib made of non-conductive resin, and a conductive rib that is provided in a lattice arrangement and is electrically connected to the ground electrode.

This structure can prevent an electrical charge buildup on the air-intake grill, thereby protecting the air-intake grill from dust. This provides not only a hard-to-collect-dust, i.e., easy-to-clean air-intake grill, but also avoids shock hazards.

According to still another aspect of the invention, the first discharge needle has a tip surrounded by the conductive rib on a projection plane.

This structure causes the discharge needle to produce a corona discharge not only at the ground electrode but also at the conductive rib of the air-intake grill. The structure extensively increases the discharge area of negative ion, enhancing negative ionization of dust. This improves filtering efficiency of the dust collector, and prevents the air-intake grill from collecting dust to an area.

According to still another aspect of the invention, the shortest distance between the tip of the first discharge needle and the ground electrode is substantially identical to the shortest distance between the tip of the first discharge needle and the conductive rib of the air-intake grill.

This structure above allows each amount of discharge from the discharge needle to the ground electrode and to the conductive rib to be balanced, thereby providing stable filtering efficiency. This structure can protect components provided on the side of the ground from unevenly collected dirt due to imbalance of discharge and from deterioration caused by dirt.

According to still another aspect of the invention, the electric dust collector may include a pawl provided at an end of the conductive rib of the air-intake grill, and an engaging section provided at the air-intake grill and having a caving shape. The engaging section is engaged with the pawl to fix the conductive rib.

This structure prevents arc discharge at the discharge needle and the tip of the conductive rib, enhancing safety. This structure provides reliable positioning of the conductive rib, simplifying an assembling work.

According to still another aspect of the invention, the ground electrode may have a frame made of metal at a perimeter thereof. The electric dust collector may further includes a connecting unit for connecting the frame of the ground electrode with the conductive rib of the air-intake grill at a plurality of positions. The connecting unit holds the non-conductive rib of the air-intake grill.

This structure can eliminate connecting parts, such as a screw, when the conductive rib is connected to the ground electrode for ground connection, simplifying an assembling work. The assembling work completes a rigid filter unit as a combination of the ground electrode having a frame structure and the air-intake grill, with the non-conductive rib is sandwiched therein. Such structured filter unit has enough strength so as to be tightly attached to the holding unit, preventing vibration noise caused by resonance in operation.

According to still another aspect of the invention, the electric dust collector may further include a flat sub-electrode plate provided on the ground electrode at a shortest distance from the first discharge needle.

This structure can protects a lath net forming the ground electrode from collecting dust caused by partial corona discharge to the edge of the lath net, preventing deterioration. Further, the structure can improve filtering efficiency by increasing the area of corona discharge to the ground electrode.

According to another aspect of the invention, the ground electrode may have a frame. The electric dust collector may further include a dust-collecting filter accommodated in the frame of the ground electrode, a burr produced on an outer side of the frame, and a filter unit frame for surrounding the filter unit through a clearance of the frame of the ground electrode. A frame wall-height of the filter unit frame measured from the ground electrode as a reference plane is larger than a frame-height of the ground electrode. A thickness of the dust-collecting filter is larger than the frame-height of the ground electrode.

This structure eliminates need for removing the burr by deflashing, thereby reducing manufacturing steps; accordingly, manufacturing cost.

According to still another aspect of the invention, the electric dust collector may further include an inflexible dust-collecting filter having an opening and accommodated in the ground electrode. The filter unit may include a lattice-shaped filter frame for holding a side of the opening of the dust-collecting filter, and a small projection provided on the lattice of the filter frame and projecting toward the dust-collecting filter.

This structure provides a small space between the dust-collecting filter and the filter frame. The small space allows air flow to be evenly provided on the entire filter, improving filtering efficiency.

According to yet another aspect of the invention, the electric dust collector may further include plural second discharge needles, and a needle-shaped electrode unit for connecting the second discharge needles to each other. The air-intake grill has a front side having an oblong groove formed therein. The needle-shapes electrode unit has a shape accommodated in the oblong groove. The electric dust collector may further include a bend strip having an L-shape fitted in a slide projection provided on an edge of the filter unit. The bend strip serves as a high-voltage power receiving terminal of the needle-shaped electrode unit. The collector may further include a needle-electrode cover for covering the needle-shaped electrode unit fitted in the groove, and a pressing rib provided at the needle-electrode cover. The needle-shaped electrode unit has a dent portion formed therein. The pressing rib contacts the dent portion of the needle-shaped electrode unit as to fix the needle-electrode cover.

In this structure, the discharge needle can be accurately fixed to a predetermined position on the filter unit through simple installation work without a screw or the like. This can prevent poor filtering efficiency caused by inaccurate installation work.

According to another aspect of the invention, an electrical device has an electric dust collector including a filter unit and a holding unit arranged to have the filter unit attached to the holding unit. The electrical device may include an electrical box having a chamber provided at an end of the holding unit, the electrical box having a chamber having a top opening, a high-voltage power supply board accommodated in the electrical box, an ultrasonic wave oscillator accommodated in the chamber of the electrical box, and a lid for covering the opening top of the chamber.

The arrangement that the high-voltage power supply board and the ultrasonic wave oscillator are included in the electrical box can shorten wiring lengths, enhancing efficiency in workability and transportation. Besides, the structure not only contributes to a downsized electric dust collector, but also protecting the ultrasonic wave oscillator and other components from collecting dust that can cause deterioration of ultrasonic wave radiation.

According to still another aspect of the invention, the electrical device may further include a bracket holder provided on a top surface of the lid, and a high-voltage power feeding bracket having one end and other end. The one end has a high-voltage power feeding terminal held by the bracket holder. The other end has a high-voltage power connector contacting the high-voltage power supply board. The high-voltage power feeding bracket is fixed to the electrical box and contacts the lid of the chamber. The high-voltage power connector is pressed to contact the high-voltage power supply board.

This structure can fix the lid and the high-voltage power feeding bracket simultaneously, thereby increasing workability and decreasing parts count.

According to another aspect of the invention, he high-voltage power feeding bracket may be made of conductive metal plate, the end and the other end of the high-voltage power feeding bracket have elasticity, and a portion of the high-voltage power feeding bracket held by the bracket holder has rigidity.

The structure allows the high-voltage power connector and the high-voltage power feeding terminal to be formed without plural components, whereby a cost-reduced product is obtained. Besides, the folded metallic plate can offer simple-structured secure fixing, with contact points properly positioned.

According to still another aspect of the invention, the chamber may have an opening to supply an ultrasonic wave generated by the ultrasonic wave oscillator to the filter unit. The chamber and the lid provides a tubular projection surrounding the ultrasonic wave oscillator and projecting towards the opening.

The structure allows the ultrasonic wave from the ultrasonic wave oscillator to be guided by the tubular projection to the opening in the chamber, whereby the ultrasonic wave can be properly directed. At the same time, dividing the tubular projection in two and disposing each half on the chamber side and the lid side allows the ultrasonic wave oscillator to be vertically sandwiched between the halves. That is, the structure can securely retain the ultrasonic wave oscillator even in the small chamber.

According to another aspect of the invention, the electrical device may further include a lead wire provided from the high-voltage power supply board and a connecting terminal provided at the electrical box and connected to the lead wire. The electrical box may have a small chamber provided in the electrical box. The small chamber surrounds the connecting terminal to protect the connecting terminal from dust.

This structure not only eliminates the need for additionally providing insulation for protecting the connector, but also protecting the contact points from collecting dust, thereby enhancing safety.

According to another aspect of the invention, an electrical device has an electric dust collector including a filter unit and a holding unit to which the filter unit is mounted. The electrical device includes an electrical box provided at an end of the holding unit, a high-voltage power supply board accommodated in the electrical box, and a high-voltage power feeding bracket removably provided at the electrical box. The high-voltage power feeding bracket has a high-voltage power feeding terminal at one end thereof, and has a high-voltage power connector at other end thereof. The high-voltage power connector contacts the high-voltage power supply board with a pressure as to fix the high-voltage power supply board to the electrical box.

This structure allows the high-voltage power feeding bracket to be fixed to the electrical box, while the high-voltage power connector of the high-voltage power feeding bracket contacts the high-voltage power supply board. In this way, the high-voltage power supply board is easily fixed in the electrical box.

According to another aspect of the invention, an electric dust collector is arranged to be mounted in an air channel and to be connected to a high voltage power supply. The electric dust collector includes a limit switch having an operation lever for turning on and off the high voltage power supply, a holding unit mounted at the air channel and holding the limit switch, a dust-collecting unit removably attached to the holding unit, a folded elastic member provided at the holding unit, the folded elastic member facing the operation lever of the limit switch, and a switch operation rib provided at the dust-collecting unit. The switch operation rib activates the folded elastic member. When the dust-collecting unit is attached to the holding unit, a force is applied through the switch operation rib to the folded elastic member as to allow the folded elastic member to deform. The folded elastic member, upon deforming, produces a repulsion force for moving the operation lever to activate the limit switch.

In the electric dust collector having the above structure, the repulsion force produced generated from the deformation of the elastic member can accommodate variations in positioning the limit switch, providing accurate operation of the limit switch.

According to another aspect of the invention, the folded elastic member has a U-shape or V-shape.

If an excessive force from the switch operation rib is applied to the elastic member, the U-shaped or V-shaped bend can absorb the force and properly control the switch operation of the limit switch.

According to another aspect of the invention, the electric dust collector may further include a support rib integrally formed with the holding unit for movably supporting the folded elastic member.

This structure allows the elastic member to be easily attached to the holding unit by fitting a folded portion into the support rib. Besides, the support rib allows an operation force to be reliably transmitted.

According to still another aspect of the invention, the holding unit may have an opening formed therein for allowing the switch operation rib is inserted through the opening when the switch operation rib moves. A rib-side arm of the folded elastic member facing the switch operation rib is larger than the opening of the holding unit. The rib-side arm of the folded elastic member almost covers the opening when the switch operation rib moves away from the opening.

When the dust-collecting unit is removed, the rib-side arm of the folded elastic member covers the opening from inside, preventing dust from entering to the limit switch through the opening. The structure can protect the limit switch from collecting dust that may cause switching failure.

According to another aspect of the invention, a lever-side arm of the folded elastic member facing the operation lever of the limit switch may have a size approximately identical to a size of the limit switch.

This lever-side arm of the folded elastic member can prevent dust from entering toward the limit switch even if dust enters inside the rib-side arm of the folded elastic member.

According to another aspect of the invention, the folded elastic member may be formed integrally on an end of the operation lever.

The structure can form the limit switch and the folded elastic member into one-piece, thereby simplifying assembly work and management of parts inventories.

According to still another aspect of the invention, the folded elastic member may include a coil spring. An elastic force of the coil spring activates the operation lever of the limit switch.

In this structure, the elasticity of the coil spring can absorb an excessive force from the switch operation rib, controlling the operation of the limit switch properly, and further, contributing to a space-saving installation.

According to still another aspect of the invention, an electric dust collector is arranged to be mounted in an air channel and to be connected to a high-voltage power supply. The electric dust collector includes a switching unit for turning on and off the high-voltage power supply, a holding unit having a shape to be placed in the air channel and for holding the switching unit, a dust collecting unit removably provided on the holding unit and having both sides substantially symmetric to each other, a ground connecting terminal provided on the holding unit, a ground terminal provided on one of the both sides of the dust collecting unit and electrically connected with the ground connecting terminal, and a high-voltage power receiving terminal provided on the one of the both sides of the dust collecting unit. The high-voltage power receiving terminal is arranged to be electrically connected with the high-voltage power supply.

With the structure above, a component is changed in its location between the left and the right sides to be applicable for the dust-collecting unit to be attached to the holding unit no matter whether the high-voltage power supply is located on left or right of the holding unit. The dust-collecting unit can thus used for the right and left.

According to another aspect of the invention, the electric dust collector may further include a switch operation rib provided on the dust collecting unit to activate the switching unit, a first drop-protection supporter for holding the dust collecting unit, and a second drop-guard supporter provided on the surface of the holding unit on which the dust-collecting unit is mounted. The first drop-guard supporter is provided on a surface of the holding unit. This surface of the dust-collecting unit has the dust collection unit mounted thereon. The second drop-protection supporter is closer to the switching unit than the first drop-guard supporter. The second drop-protection supporter has a holding power is smaller than a holding power of the first drop-guard supporter.

This structure allows the dust-collecting unit to be easily pulled out without torsion.

According to another aspect of the invention, the first drop-guard supporter may include a first head having a spherical shape, and a first coil spring for pushing the first head. The second drop-guard supporter may include a second head having a spherical shape, and a second coil spring for pushing the second head. The second coil spring is different from the first coil spring in at least one of shape and material.

With the structure above, different bearing power can be given to each coil spring of the drop-guard supporters by providing a minor change in shape or material of the coil spring.

According to another aspect of the invention, the first drop-protection supporter may include a first head having a spherical shape, a first coil spring for pushing the first head, and a first housing for accommodating the first coil spring. The second drop-guard supporter may include a second head having a spherical shape, a second coil spring for pushing the second head, and a second housing for accommodating the second coil spring. The second housing has an accommodating size different from an accommodating size of the first housing.

The structure above eliminates the need for preparing different types of the coil spring, contributing to standardization of components to be used.

According to another aspect of the invention, the electric dust collector may further include a high-voltage power supply unit having a shape mountable to the holding unit and having both sides substantially symmetrical to each other, and a first high-voltage power feeding terminal and a first ground connecting terminal mounted to one of the both sides of the high-voltage power supply unit. The high-voltage power supply unit functions as the high-voltage power supply. The first high-voltage power feeding terminal and the first ground connecting terminal are capable of each of the both sides of the high-voltage power supply unit. The high-voltage power receiving terminal and the ground terminal are provided at the dust-collecting unit so as to correspond to the first high-voltage power feeding terminal and the first ground connecting terminal, respectively.

With the structure above, the high-voltage power supply unit can be used commonly.

As another aspect of the present invention, the electric dust collector may further include a second high-voltage power feeding terminal and a second ground connecting terminal that are provided at other of the both sides of the high-voltage power supply unit, another holding unit provided on the other of the both sides of the high-voltage power supply unit, and another dust-collecting unit attached to the another holding unit.

This structure allows components for home use to expand to large-sized structure for business or industry use.

According to another aspect of the invention, the electric dust collector may further include a pair of rails provided on upper sides of the dust-collecting unit, and a pair of eaves provided on the holding unit so as to slidably hold the rails. The rails are parallel with each other.

With the structure above, the dust-collecting unit can be attached or removed without torsion no matter whether the switching unit is provided on the right or the left.

DETAILED DESCRIPTION OF THE PREFERRED EMBODIMENTS

Exemplary Embodiment 1

Figure 1A:
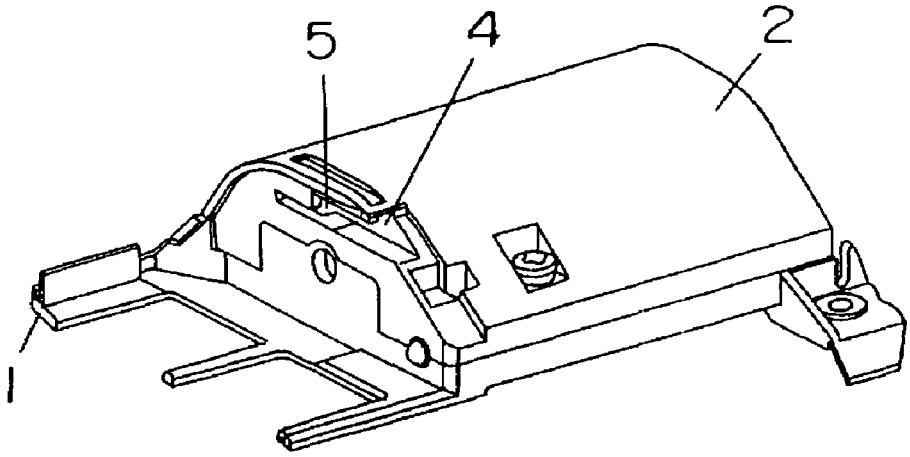
FIG. 1A is a perspective view of a high-voltage applying device of an electric dust collector of Exemplary Embodiment 1 of the present invention.
Figure 1B:
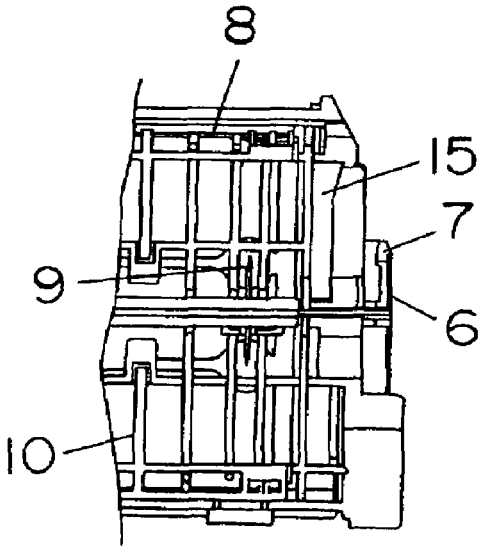
FIG. 1B is a front view of a filter unit of the electric dust collector of Embodiment 1.
Figure 1C:
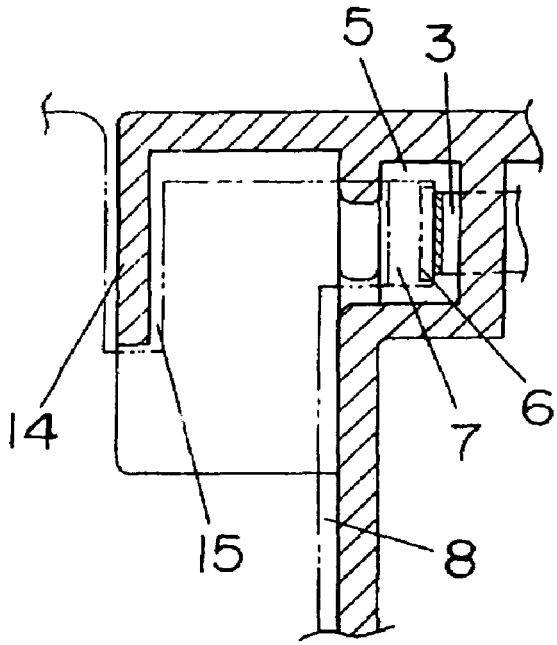
FIG. 1C is a section view of an essential part of the electric dust collector of Embodiment 1.
Figure 2:
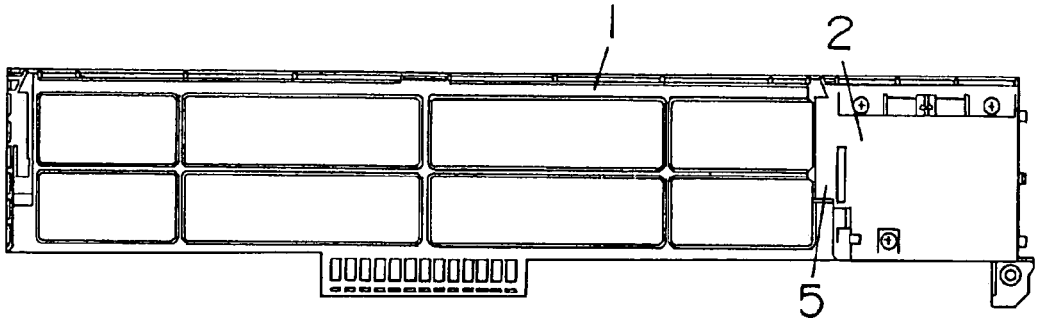
FIG. 2 is a front view of a holding unit of the electric dust collector of Embodiment 1.
Figure 3:
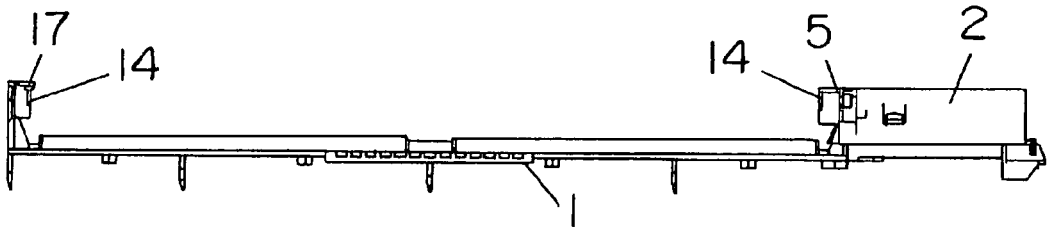
FIG. 3 is a side view of the electric dust collector for showing a guide rib of Embodiment 1.
Figure 4:
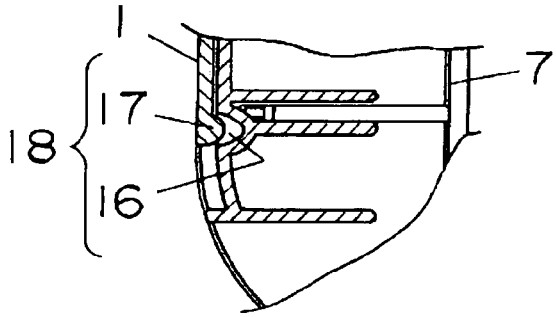
FIG. 4 is a section view of the electric dust collector for showing an engaging unit of Embodiment 1.
Figure 5:
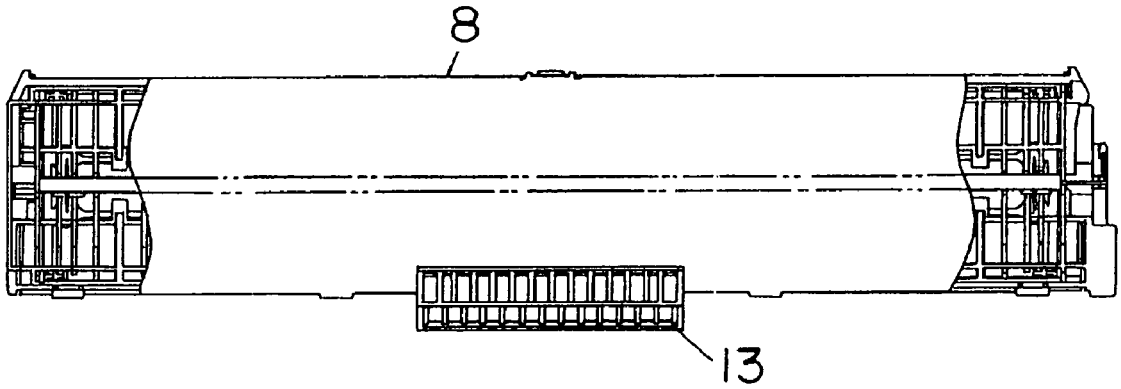
FIG. 5 is a front view of the filter unit of the electric dust collector of Embodiment 1.

FIG. 1A is a perspective view of a high-voltage applying device of an electric dust collector according to Exemplary Embodiment 1 of the present invention. FIG. 1B is a front view of a filter unit of the electric dust collector of Embodiment 1. FIG. 1C is a section view of an essential part of the electric dust collector of Embodiment 1. FIG. 2 is a front view of a holding unit of the electric dust collector of Embodiment 1. FIG. 3 is a side view showing a guide rib of the electric dust collector of Embodiment 1. FIG. 4 is a section view of an engaging unit of the electric dust collector of Embodiment 1. FIG. 5 is a front view of the filter unit of the electric dust collector of Embodiment 1.

As shown in FIG. 1A to FIG. 5, high-voltage applying device 2 provided at an end of oblong holding unit 1 provided in an air channel of an air conditioner (not shown). Flat spring-shaped high-voltage power feeding terminal 3 connected to high-voltage applying device 2 is provided in contact protector 5 with front opening 4 of substantially inverted U-shape for accommodating high-voltage power feeding terminal 3. Slide projection 7 removably provided on filter unit 8 has high-voltage power receiving terminal 6 removably fitted into contact protector 5, allowing filter unit 8 to be removably attached to holding unit 1. Filter unit 8 has air-intake grill 10 having discharge needle 9 connected to high-voltage power receiving terminal 6. Ground electrode 11 and dust collecting filter 12 are provided on leeward side of discharge needle 9. Air-intake grill 10 has handle 13 with which filter unit 8 is fixed to or removed from holding unit 1.

Guide rib 14 is provided at high-voltage applying device 2 so as to be parallel to the direction in which filter unit 8 is pulled out. For accepting guide rib 14, filter unit 8 has groove 15 that reaches substantially the midpoint of filter unit 8. Filter unit 8 contains dent 16 and engaging projection 17. Dent 16 is provided at an end of filter unit 8 opposite to the end having high-voltage power receiving terminal 6. Engaging projection 17, which is elastically engaged with dent 16, is provided on a side opposite to the side having high-voltage applying device 2 of holding unit 1. Dent 16 and projection 17 provide latching unit 18 so as to temporarily fix filter unit 8 to holding unit 1 when filter unit 8 is pulled out.

In the above structure, when air flows into filter unit 8 that is provided via holding unit 1 on the air channel of the air conditioner, ground electrode 11 and negative high-voltage applied via high-voltage power receiving terminal 6 to discharge needle 9 provided on air-intake grill 10 generate a large electric field around discharge needle 9. In an area affected by the electric field, separation and union of electrons of air molecules, ionized air molecules provide air ions. The force of the electric field causes the air ions to spread around and stick to dust, and causes dust particles bear to be electrically charged. The charged dust particles avoid interference between particles and gather to dust collecting filter 12 provided on the leeward side of ground electrode 11, thus allowing the dusts to be collected.

To remove the dust accumulated on the filter unit, filter unit 8 is pulled out from holding unit 1 with handle 13. In the structure, filter unit 8 is fixed to holding unit 1. At one side of filter unit 8, slide projection 7 having high-voltage power receiving terminal 6 provided on filter unit 8 is removably fitted in contact protector 5 with front opening 4 having a recess shape and accommodates elastic high-voltage power feeding terminal 3 connected to high-voltage applying device 2. At the other side of filter unit 8, dent 16 provided on filter unit 8 has an elastic engagement with engaging projection 17 provided on holding unit 1, which forms latching unit 18 for temporarily retaining filter unit 8. Therefore, filter unit 8 can be retained with almost the same connecting power given on its both sides. Filter unit 8 can be pulled out with handle 13 in a manner that guide rib 14 on holding unit 1 slides along groove 15 on filter unit 8. After removed from holding unit 1, filter unit 8 is washed by water to remove dust. When dust collecting filter 12 is replaced, filter unit 8 is removed.

After cleaning filter unit 8 or replacing dust-collecting unit 12, filter unit 8 is mounted on holding unit 1. Slide projection 7 having receiving terminal 6, which is provided on one side of filer unit 8, is engaged with front opening 4 of contact protector 5. Then, filter unit 8 is moved toward the fixing position on the side of holding unit 1. One side of filter unit 8 is guided by engagement of groove 15 provided on filter unit 8 and guide rib 14 provided on holding unit 1. High-voltage power receiving terminal 6 of slide projection 7 is elastically engaged with high-voltage power feeding terminal 3 in contact protector 5. At the other side of filter unit 8, engaging projection 17 on holding unit 1 which forms latching unit 18 is engaged elastically with dent 16 on filter unit 8, thus having filter unit 8 mounted on holding unit 1.

According to Embodiment 1, as described above, the electric dust collector includes oblong holding unit 1 provided in an air channel of an air conditioner and the like, high-voltage applying device 2 provided at an end of holding unit 1, contact protector 5 having front opening 4 of substantially inverted U-shape for accommodating flat spring-shaped high-voltage power feeding terminal 3 connected to high-voltage applying device 2, filter unit 8 removably attached to holding unit 1, and slide projection 7 removably provided on filter unit 8. Slide projection 7 has high-voltage power receiving terminal 6 removably fitted into contact protector 5, allowing filter unit 8 to be removably attached to holding unit 1. The structure in which high-voltage power feeding terminal 3 is covered with contact protector 5 having inverted U-shape can keep high-voltage power feeding terminal 3 from collecting dust. The structure not only prevents contact failure or electrical leak that is possibly caused by dust, but also protects hands or fingers from accidentally touching high-voltage power feeding terminal 3, thereby increasing safety. Besides, compared to the structure in which application of high voltage is controlled by a limit switch, the electric dust collector of the present invention can provide a cost-reduced simple structure.

Besides, in the structure above, guide rib 14 is provided on holding unit 1 or high-voltage applying device 2 so as to be parallel to the direction in which filter unit 8 is pulled out, and on filter unit 8, groove 15, through which guide rib 14 slides, reaches substantially the midpoint of filter unit 8. This structure allows filter unit 8 to be moved in substantially parallel direction between one end of holding unit 1 and high-voltage applying device 2, with guide rib 14 met with groove 15. In this way, filter unit 8 can be smoothly removed without torsion, eliminating problems caused by torsion.

In addition, latching unit 18, by which filter unit 8 is temporarily retained by holding unit 1, is provided on a side of filter unit 8 opposite to the side having high-voltage power receiving terminal 6. Having latching unit 18 increases connecting force on the side opposite to the side having the high-voltage applying device as substantially the same as the side having high-voltage power feeding terminal 3. The structure allows the side opposite to the side having the high-voltage applying device to pull off first, thereby eliminating difficulties with torsion in removing filter unit 8.

Although guide rib 14 is provided on high-voltage applying device 2 in the first exemplary embodiment, it is not limited thereto. Forming guide rib 14 on holding unit 1 can offer similar effect.

Exemplary Embodiment 2

Figure 6:
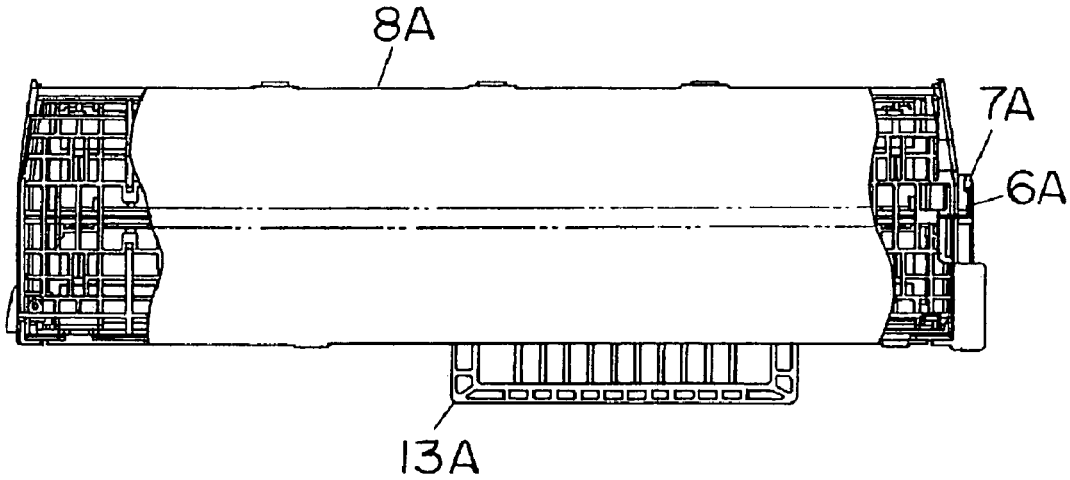
FIG. 6 is a front view of a filter unit of an electric dust collector of Exemplary Embodiment 2 of the invention.

FIG. 6 is a front view of a filter unit of an electric dust collector according to Exemplary Embodiment 2 of the present invention. In the structure, handle 13A is positioned on filter unit 8A so as to be shifted toward the side of high-voltage power receiving terminal 6A.

In the structure above, high-voltage power receiving terminal 6A provided on slide projection 7A has electrical connections with the high-voltage power feeding terminal in the contact protector provided on the high-voltage applying device of the holding unit (not shown). The electrical connections allow the side of high-voltage power receiving terminal 6A to provide a connecting force tighter than the other side of filter unit 8A. When filter unit 8A is pulled out by using handle 13A provided at the midpoint of filter unit 8A, the side with looser connecting force, i.e., the side opposite to the side having high-voltage applying device, tends to come off ahead, thereby causing torsion. However, by disposing handle 13A on filter unit 8A so as to shift toward the side with tighter connecting force, i.e., the side of high-voltage power receiving terminal 6A, pulling-out force with handle 13A is strongly applied to the side of high-voltage power receiving terminal 6A, whereby both sides can be pulled out substantially simultaneously without torsion.

In the electric dust collector according to Embodiment 2, handle 13A is provided to shift toward the side of high-voltage power receiving terminal 6A, on filter unit 8A. Pulling-out force with handle 13A is strongly applied to the side that attaches to the holding unit tighter than the opposite side having high-voltage power receiving terminal 6A, whereby the tighter-connected side can be pulled out at almost the same time with the other side, encouraging a smooth pull-out of filter unit 8A.

Exemplary Embodiment 3

Figure 7:
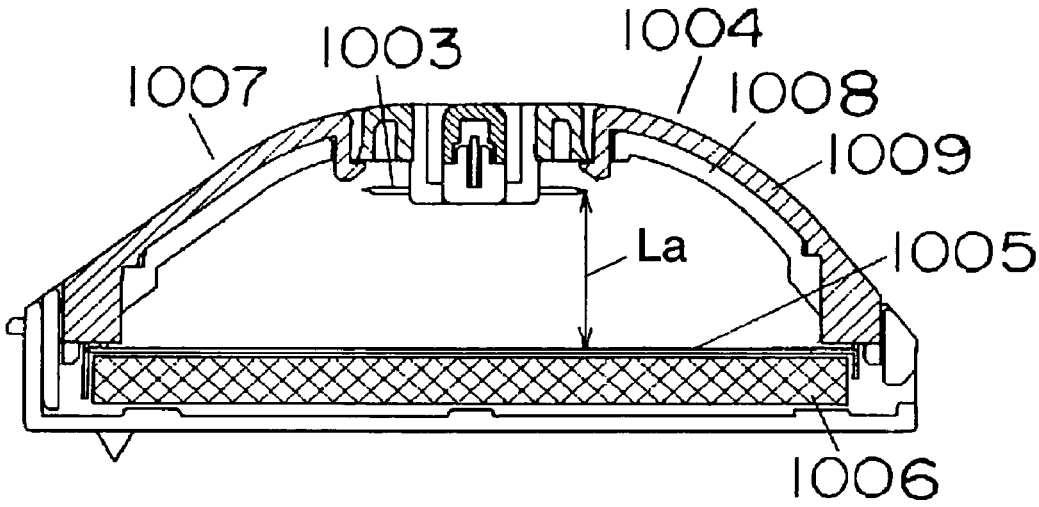
FIG. 7 is a section view of a filter unit of an electric dust collector of Exemplary Embodiment 3 of the invention.
Figure 8:
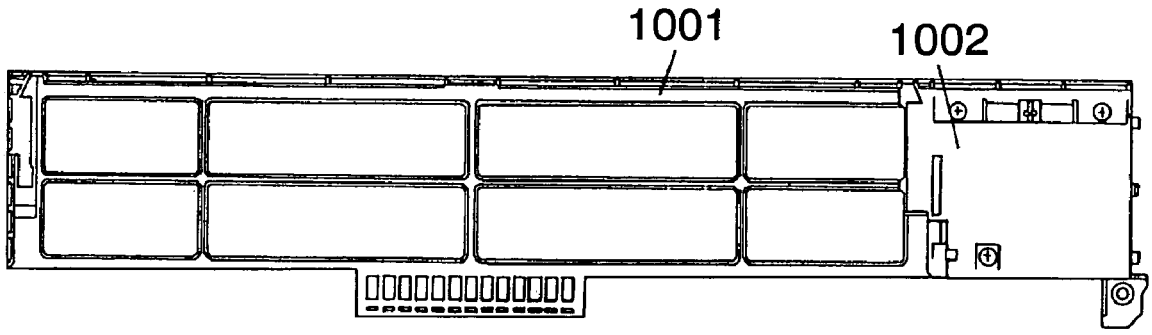
FIG. 8 is a front view of a holding unit of the electric dust collector of Embodiment 3.
Figure 9:
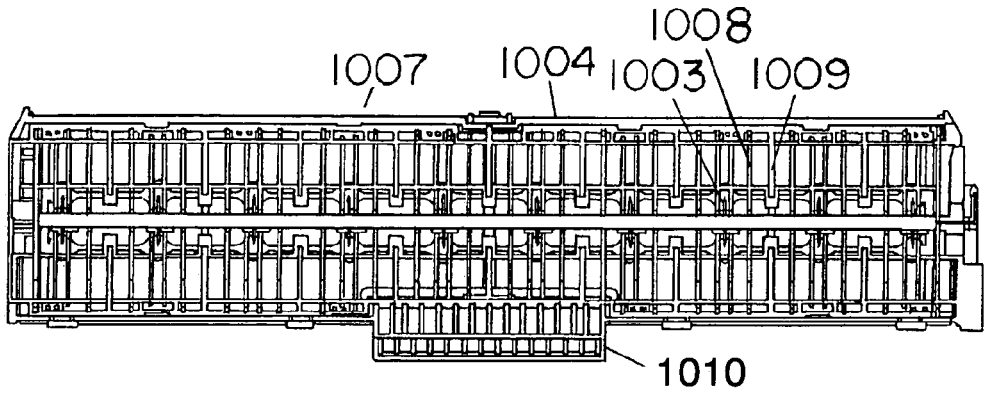
FIG. 9 is a front view of the filter unit of the electric dust collector of Embodiment 3.
Figure 10:
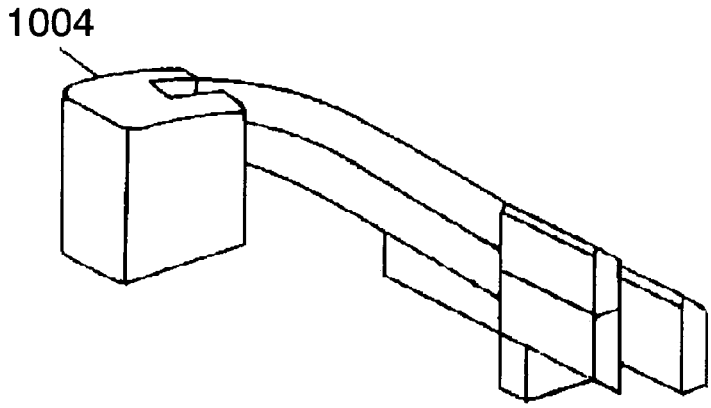
FIG. 10 is a perspective view of the electric dust collector for showing an engaging section for engagement with a conductive rib of Embodiment 3.
Figure 11:
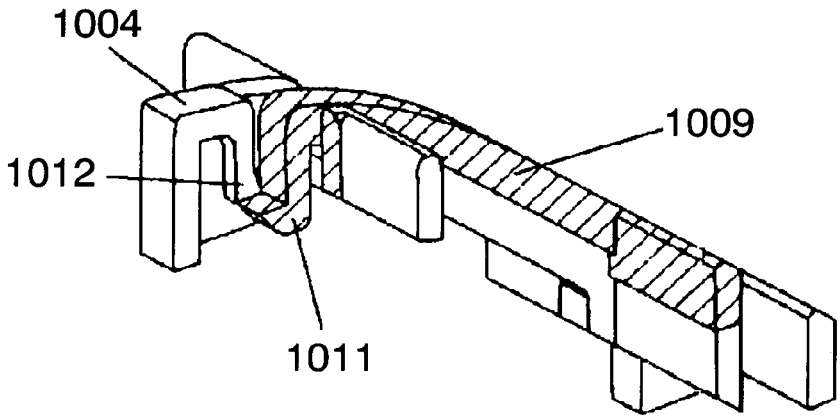
FIG. 11 is a perspective view of an essential part of the electric dust collector of Embodiment 3.
Figure 12:
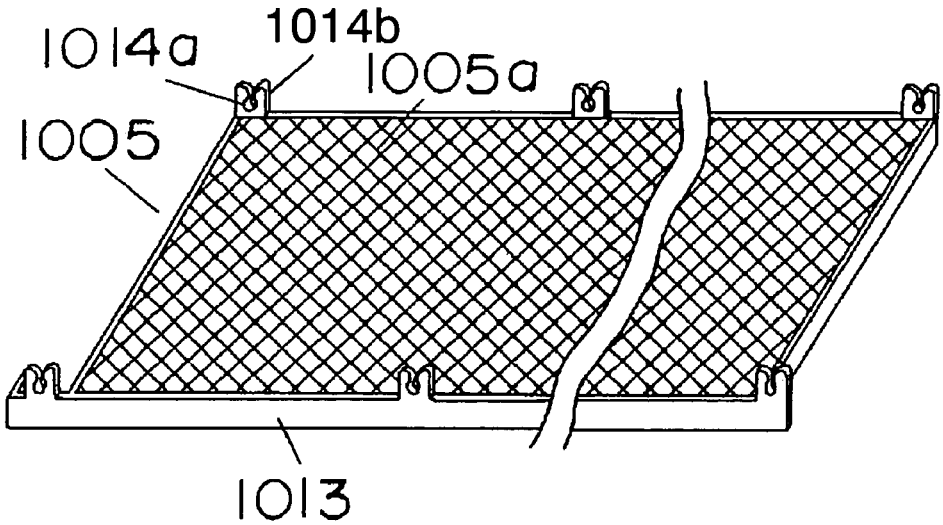
FIG. 12 is a perspective view of a ground electrode of the electric dust collector of Embodiment 3.
Figure 13:
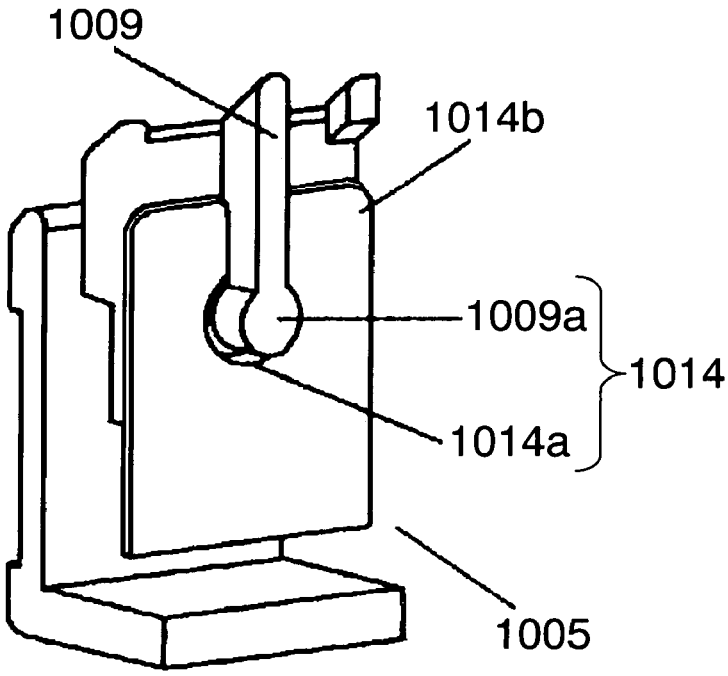
FIG. 13 is a perspective view of the electric dust collector of Embodiment 3.
Figure 14:
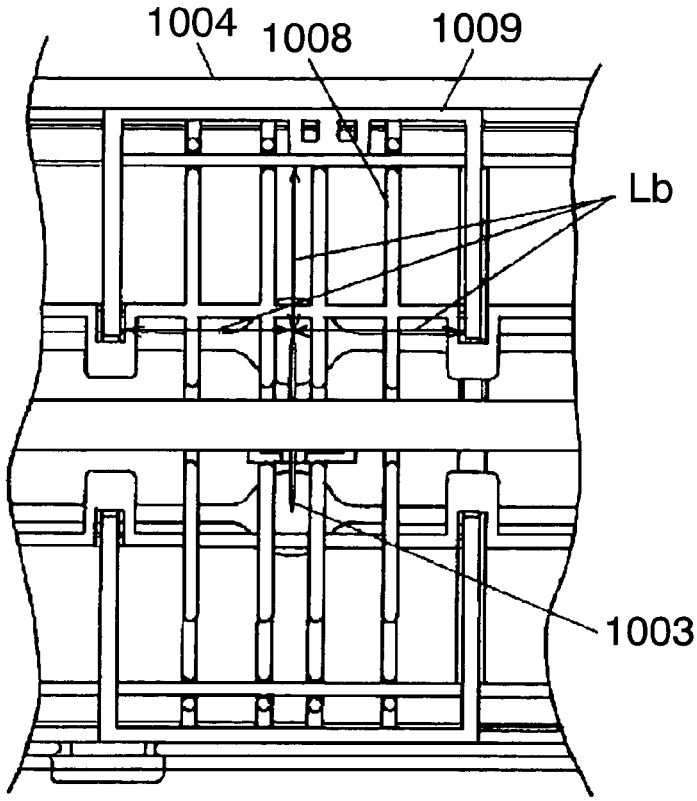
FIG. 14 is a front view of an essential part of the electric dust collector of Embodiment 3.
Figure 15:
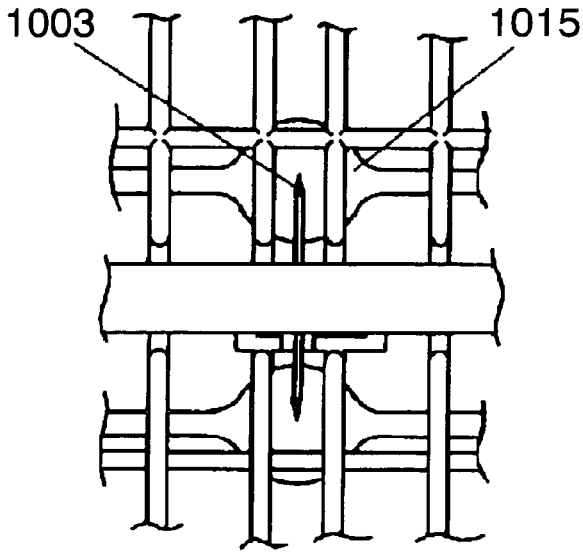
FIG. 15 is a front view of an essential part of a sub-electrode plate of the electric dust collector of Embodiment 3.
Figure 16:
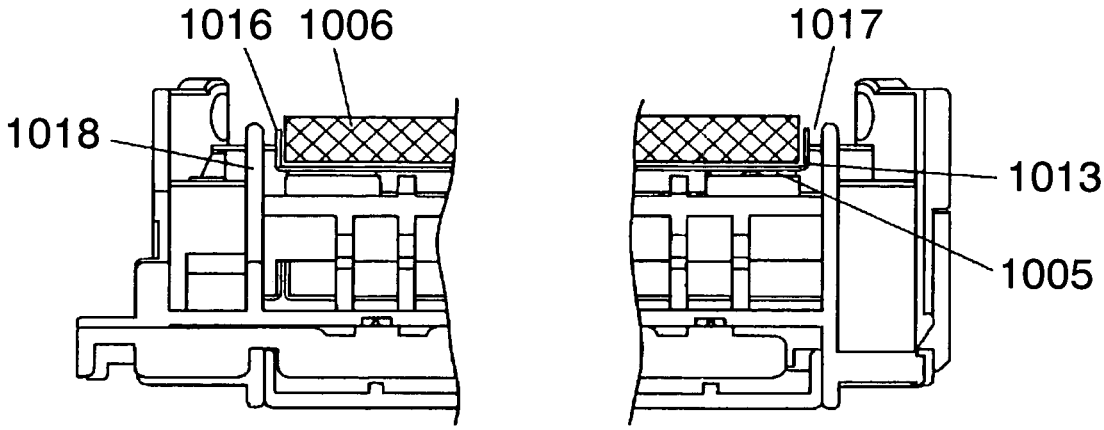
FIG. 16 is a section view of the electric dust collector of Embodiment 3.
Figure 17:
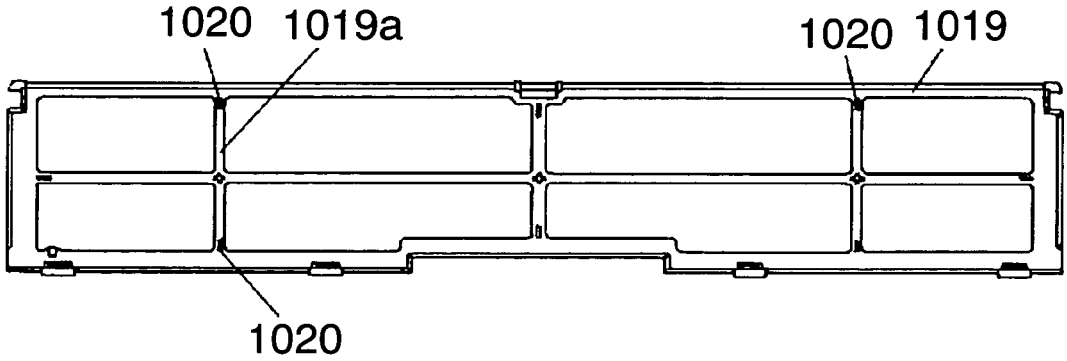
FIG. 17 is a front view of the electric dust collector for showing a filter frame of Embodiment 3.
Figure 18:
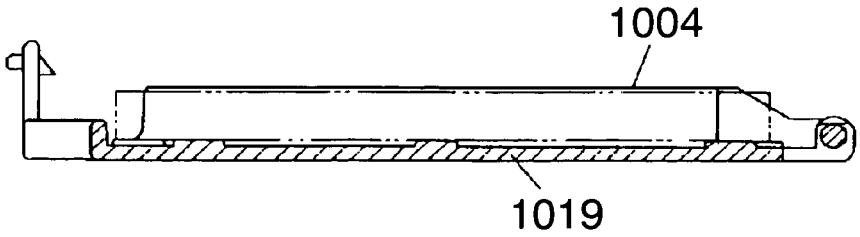
FIG. 18 is a side view of the electric dust collector of the Embodiment 3.
Figure 19:
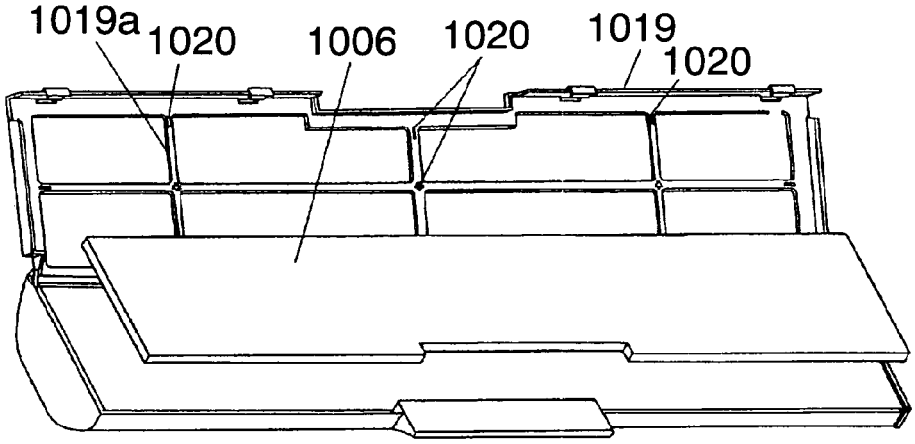
FIG. 19 is an exploded perspective view of the electric dust collector of Embodiment 3.
Figure 20:
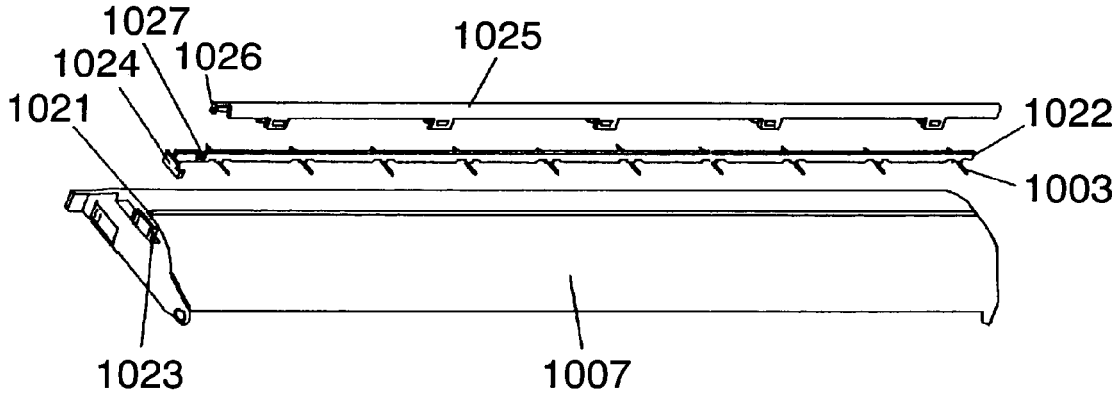
FIG. 20 is an exploded perspective view of the electric dust collector of Embodiment 3.
Figure 21:
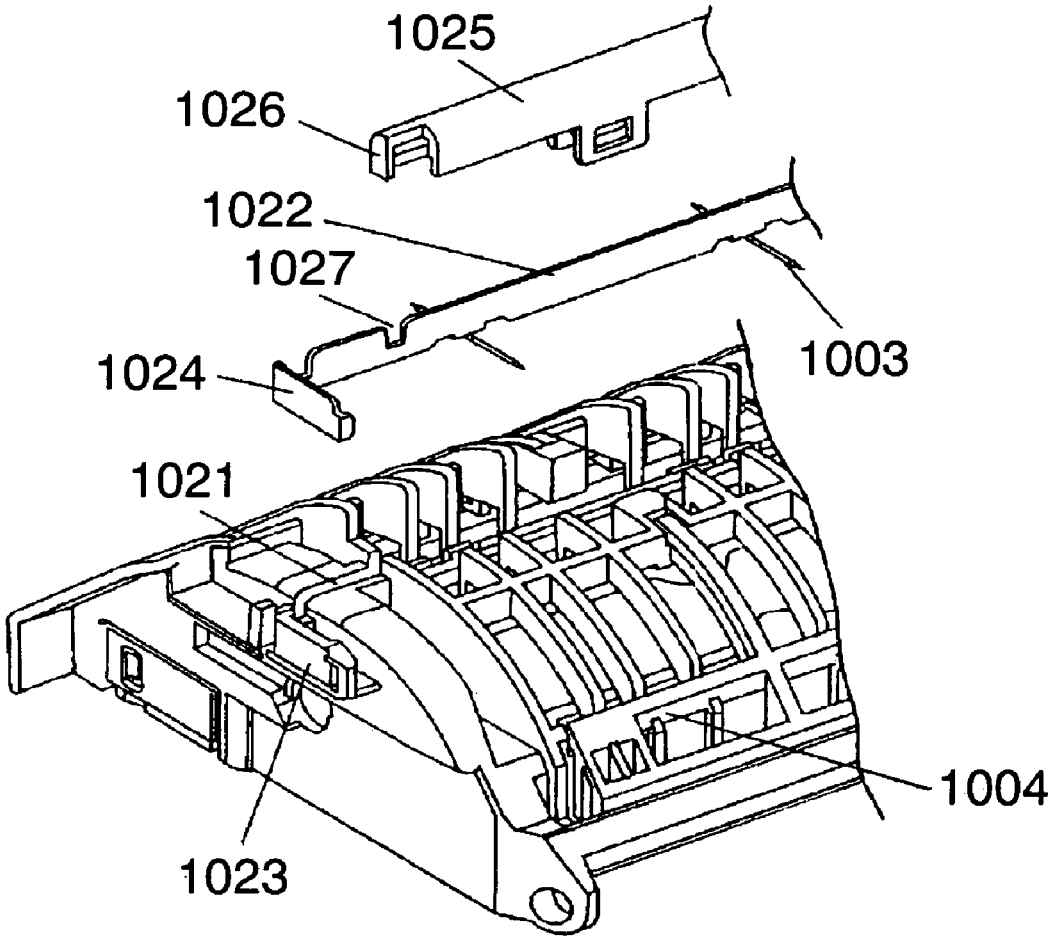
FIG. 21 is an enlarged view of the electric dust collector of Embodiment 3.

FIG. 7 is a section view of a filter unit of an electric dust collector according to Exemplary Embodiment 3 of the present invention. FIG. 8 is a front view of a holding unit of the electric dust collector of Embodiment 3. FIG. 9 is a front view of a filter unit of the electric dust collector of Embodiment 3. FIG. 10 is a perspective view of an engaging section having an engagement with a conductive rib of the electric dust collector of Embodiment 3. FIG. 11 is a perspective view of the essential part of the electric dust collector of Embodiment 3. FIG. 12 is a perspective view of a ground electrode of the electric dust collector of Embodiment 3. FIG. 13 is a perspective view of the electric dust collector of Embodiment 3. FIG. 14 is a front view of the essential part of the electric dust collector of Embodiment 3. FIG. 15 is a front view showing the essential part of a sub-electrode plate of the electric dust collector of Embodiment 3. FIG. 16 is a section view of the electric dust collector of Embodiment 3. FIG. 17 is a front view showing a filter frame of the electric dust collector of Embodiment 3. FIG. 18 is a side view of the electric dust collector of Embodiment 3. FIG. 19 is an exploded perspective view of the electric dust collector of Embodiment 3. FIG. 20 is an exploded perspective view of the electric dust collector of Embodiment 3. FIG. 21 is an enlarged view of the electric dust collector of Embodiment 3.

As shown in FIG. 7 to FIG. 21, high-voltage applying device 1002 is provided on one end of oblong holding unit 1001 located at an air channel in an air conditioner (not shown) or the like. Filter unit 1007 is removably mounted on holding unit 1001. Filter unit 1007 includes discharge needle 1003 having electrical connections to high-voltage applying device 1002, front-swelled air-intake grill 1004, and ground electrode 1005 and dust collecting filter 1006 provided on the leeward side of discharge needle 1003.

Air-intake grill 1004 includes non-conductive rib 1008 made of non-conductive resin, and lattice-shaped conductive rib 1009 made of conductive resin. The tip of discharge needle 1003 is surrounded by conductive rib 1009 on a projection plane. Air-intake grill 1004 contains handle 1010.

Pawl 1011 is formed on the tip of conductive rib 1009. Engaging section 1012 of a caving shape is provided on air-intake grill 1004 made of non-conductive resin. Engaging pawl 1011 with engaging section 1012 fixes conductive rib 1009 to air-intake grill 1004.

Ground electrode 15 has metallic frame 1013 on its perimeter, and air-permeable lath net 1005*a* inside the frame. Frame 1013 made of includes plural holders 1014*b* each of which has notch 1014*a* that is cut out in a ladle-like shape—round hole led by a notch. Ladle-like projection 1009*a* is formed on conductive rib 1009. Projection 1009*a* is fitted into notch 1014*a* of holders 1014*b* of ground electrode 1005, forming connecting unit 1014 between conductive rib 1009 and ground electrode 1005. Conductive rib 1009 is connected to ground electrode 1005 in such a way that connecting unit 1014 sandwiches non-conductive rib 1008 of air-intake grill 1004.

The shortest distance "La" (in FIG. 7) between the tip of discharge needle 1003 and ground electrode 1005 is determined to be substantially identical to the shortest distance "Lb" (in FIG. 14) between the tip of discharge needle 1003 and conductive rib 1009 of air-intake grill 1004. Round and flat sub-electrode plate 1015 is provided at a position nearest from ground electrode 1005.

The electric dust collector includes dust-collecting filter 1006 that is accommodated in frame 1013 of ground electrode 1005, burrs 1016 formed on the outer side of the frame in a cutting procedure, and filter unit frame 1018 surrounding the filter unit through clearance 1017 of frame 1013 of ground electrode 1005. In the structure, the frame wall height of filter unit frame 1018, which is measured from ground electrode 1005 as a reference plane, is determined to be higher than the height of frame 1013 having burrs 1016 of ground electrode 1005. The thickness of dust-collecting filter 1006 is determined to be greater than the frame wall height of frame 1013 of ground electrode 1005.

Lattice-shaped inflexible filter frame 1019 is movably provided on air-intake grill 1004. Filter frame 1019 holds the side of the opening of dust-collecting filter 1006 that is accommodated in ground electrode 1005. Small projection 1020 is provided on lattice 1019*a* of filter frame 1019 so as to face dust-collecting filter 1006.

In an electric dust collector of Embodiment 3 of the invention, accommodating groove 1021 having an oblong shape and electrode unit 1022 having a needle shape are provided on the front side of air-intake grill 1004. Needle-shaped electrode unit 1022 is formed of connected discharge needles 1003 and is accommodated in groove 1021. The dust collector further includes bend 1024 having an L-shape serving as a high-voltage power receiving terminal of needle-shaped electrode unit 1022 and fitted in slide projection 1023 provided on the edge of filter unit 1007, needle-electrode cover 1025 for covering needle-shaped electrode unit 1022 fitted in groove 1021, and pressing rib 1026 provided on needle-electrode cover 1025. Needle-shaped electrode unit 1022 has dent portion 1027. Pressing rib 1026 contacts dent portion 1027 of needle-shaped electrode unit 1022, so that needle-shaped electrode unit 1022 is secured.

In the structure above, when the air flows into filter unit 1007 provided via the holding unit on the air channel of an air conditioner, ground electrode 1005 and negative high-voltage that is applied via high-voltage power receiving terminal 6 to discharge needle 9 provided on air-intake grill 1004 generates a great electric field around discharge needle 1003. In an area affected by the electric field, by separation and bonding of electrons of air molecules, ionized air molecules become air ions. Under the force of the electric field, the air ions spread around and stick to dust, by which dust particles bear electrical charges. The charged dust particles avoid interference between particles and gather to dust collecting filter 1006, which is provided on the leeward side of ground electrode 1005. Dust is thus collected.

According the electric dust collector of Embodiment 3 of the invention, high-voltage applying device 1002 is provided on one end of oblong holding unit 1001 provided on the air channel of an air conditioner and the like, and filter unit 1007 is removably provided on holding unit 1001. Filter unit 1007 has discharge needle 1003 electrically connected to high-voltage applying device 1002, front-swelled air-intake grill 1004, air-permeable ground electrode 1005, and dust-collecting filter 1006 on the leeward side of discharge needle 1003. Filter unit 1007 is removably amounted on holding unit 1001. Non-conductive rib 1008 made of non-conductive resin, and lattice-shaped conductive rib 1009 made of conductive resin are provided on air-intake grill 1004. Connecting conductive rib 1009 to ground electrode 1005 can dissipate static charges as they develop on air-intake grill 1004, thereby preventing dust collection on air-intake grill 1004. This can provide not only a hard-to-collect-dust, i.e., easy-to-clean structure, but also avoid shock hazards.

Air-intake grill 1004 is formed so that the tip of discharge needle 1003 is surrounded by conductive rib 1009 on a projection plane. With the structure above, the corona discharge from discharge needle 1003 can be performed not only at ground electrode 1005 but also at conductive rib 1009 of air-intake grill 1004. The structure extensively increases the discharge area of negative ion, enhancing negative ionization of dust. This improves filtering efficiency of the dust collector, at the same time, prevents air-intake grill 1004 from collecting dust to an area.

In addition, the shortest distance "La" between the tip of discharge needle 1003 and ground electrode 1005 is determined to be substantially identical to the shortest distance "Lb" between the tip of discharge needle 1003 and conductive rib 1009 of air-intake grill 1004. With the structure above, each amount of discharge from discharge needle 1003 to ground electrode 1005 and to conductive rib 1009 can be balanced, whereby stable filtering efficiency is obtained. This structure can protect components provided on the side of the ground from unevenly collected dirt due to imbalance of discharge and from deterioration caused by dirt.

The electric dust collector includes pawl 1011 provided at the tip of conductive rib 1009 of air-intake grill 1004, and engaging section 1012 with a U-shape provided on air-intake grill 1004. The engagement of engaging section 1012 with pawl 1011 attaches conductive rib 1009 to air-intake grill 1004. The structure above prevents arc discharge at discharge needle 1003 and the tip of conductive rib 1009, enhancing safety. Besides, the structure provides reliable positioning of conductive rib 1009, simplifying the assembly work.

The structure includes ground electrode 1005 having frame 1013 made of metal around the perimeter. Frame 1013 includes plural connecting unit 1014 with which frame 1013 of ground electrode 1005 is attached to conductive rib 1009 of air-intake grill 1004. Connecting unit 1014 sandwiches non-conductive rib 1008 of air-intake grill 1004. The structure can eliminate the need for using fixing parts, such as screws, thereby contributing to a simplified assembly work. Once assembled, ground electrode 1005 with a frame structure and air-intake grill 1004 forms a rigidly united filter unit 1007, providing strength against mounting on, or dismounting from holding unit 1001. This structure can prevent vibration noise caused by resonance in operation.

In the structure of the embodiment, sub-electrode plate 1015 having a plate shape is provided on ground electrode 1005 at a position having the shortest distance from discharge needle 1003. The structure above can protect lath net 1005*a* forming ground electrode 1005 from collecting dust to the edge of lath net 1005*a* due to partially performed corona discharge, preventing deterioration caused by dust collection. This structure can improve filtering efficiency by increasing the area of corona discharge to ground electrode 1005.

The electric dust collector of the embodiment includes dust-collecting filter 1006 that is accommodated in frame 1013 of ground electrode 1005, burrs formed on the outer side of frame 1013, and filter unit frame 1018 surrounding the filter unit through clearance 1017 of frame 1013 of ground electrode 1005. In the structure, the frame wall height of filter unit frame 1018, which is measured from ground electrode 1005 as a reference plane, is determined to be higher than the height of frame 1013 of ground electrode 1005, and at the same time, the thickness of dust-collecting filter 1006 is determined to be greater than the frame wall height of frame 1013 of ground electrode 1005. That is, each of the frame wall of filter unit frame 1018 and the thickness of dust-collecting filter 1006 is greater in height than burrs 1016 left on the outer sides of frame 1013 of ground electrode 1005 when metal cutting procedures. The structure eliminates the need for removing burrs 1016 by deflashing, thereby reducing manufacturing steps; accordingly, manufacturing cost.

An electric dust collector of the embodiment includes dust-collecting filter 1006 having an opening. Dust-collecting filter 1006 is inflexible and is accommodated in ground electrode 1005. Filter unit 1006 contains lattice-shaped filter frame 1019 for holding the side of the opening of dust-collecting filter 1006, and small projection 1020 provided on lattice 1019*a* of filter frame 1019 so as to face dust-collecting filter 1006. This structure provides a small space between dust-collecting filter 1006 and filter frame 1019. The small space allows airflow to be evenly provided over the entire filter, improving filtering efficiency.

An electric dust collector of the embodiment includes accommodating groove 1021 having an oblong shape formed on the front side of air-intake grill 1004, needle-shaped electrode unit 1022 connecting plural discharge needles 1003 having shapes accommodated in groove 1021, bend 1024 having an L-shape and serving as a high-voltage power receiving terminal of needle-shaped electrode unit 1022 and fitted in slide projection 1023 provided on the edge of filter unit 1007, needle-electrode cover 1025 for covering needle-shaped electrode unit 1022 fitted in groove 1021, and pressing rib 1026 provided on needle-electrode cover 1025. Needle-shaped electrode unit has dent 1027. Pressing rib 1026 contacts dent 1027 of needle-shaped electrode unit 1022 to fix needle-electrode cover 1025. This structure allows discharge needles 1003 to be accurately fixed to a predetermined position on filter unit 1007 through simple installation work without a screw or the like. This can prevent poor filtering efficiency caused by inaccurate installation work.

According to Embodiment 3, the dust collector includes an oblong holding unit provided in an air channel of an air conditioner and the like, a high-voltage applying device provided on one end of the holding unit, and a filter unit removably mounted on the holding unit. The filter unit includes a front-swelled air-intake grill having a discharge needle electrically connected to the high-voltage applying device, an air-permeable ground electrode and a dust-collecting filter on the leeward side of the discharge needle. The air-intake grill is formed of a non-conductive rib made of non-conductive resin and a lattice-shaped conductive rib made of conductive resin. The conductive rib connected to the ground electrode can prevent dust collection on the air-intake grill. This can provide not only a hard-to-collect-dust, easy-to-clean structure, but also avoid shock hazards.

The air-intake grill is formed so that the tip of the discharge needle is surrounded by the conductive rib on a projection plane. The structure improves filtering efficiency of the dust collector, at the same time, prevents concentrating dust to an area in the air-intake grill.

In addition, the shortest distance between the tip of the discharge needle and the ground electrode is determined to be substantially identical to the shortest distance between the tip of the discharge needle and the conductive rib of the air-intake grill. The structure can not only improve filtering efficiency, but also protect components provided on the side of the ground from unevenly collected dirt due to imbalance of discharge and from deterioration caused by dirt.

The electric dust collector includes a pawl provided at the tip of the conductive rib of the non-conductive resin-made air-intake grill, and an engaging section with a caving shape provided on the air-intake grill. The engaging section engaged with the pawl attaches the conductive rib to the air-intake grill. The structure prevents arc discharge, enhancing safety. Besides, the structure provides reliable positioning of the conductive rib, simplifying the assembling work.

The electric dust collector includes a ground electrode having a frame made of metal around the perimeter. The frame includes plural connecting unit, with which the frame of the ground electrode is attached to the conductive rib of the air-intake grill. The connecting unit sandwiches the non-conductive rib of the air-intake grill. This structure allows the filter unit to have a rigid structure in a simplified assembly work. Besides, the structure can prevent vibration noise caused by resonance in operation.

In the structure of the embodiment, a sub-electrode plate having a plate shape is provided on the ground electrode at a position having the shortest distance from the discharge needle. The structure above can protect a lath net forming the ground electrode from deterioration caused by unevenly collected dust. This structure can improve filtering efficiency.

The electric dust collector of the embodiment includes a dust-collecting filter that is accommodated in the frame of the ground electrode, burrs formed on the outer side of the frame, and a filter unit frame surrounding the filter unit through a clearance of the frame of the ground electrode. In the structure, the frame wall height of the filter unit frame (measured from the ground electrode as a reference plane) is determined to be higher than the height of the frame of the ground electrode. The thickness of the dust-collecting filter is determined to be greater than the frame wall height of the frame of the ground electrode. The structure eliminates the need for removing the burrs by deflashing, thereby not only removing worry about getting injury by the burrs, but also eliminating manufacturing processes, accordingly, reducing its manufacturing cost.

An electric dust collector of the embodiment includes a dust-collecting filter with an opening. The dust-collecting filter is inflexible and is accommodated in the ground electrode. The filter unit includes a lattice-shaped filter frame for holding the side of the opening of the dust-collecting filter, and a small projection provided on the lattice of the filter frame so as to face the dust-collecting filter. The structure allows airflow to be evenly provided over the entire filter, improving filtering efficiency.

An electric dust collector of the embodiment includes an oblong groove formed on the front side of the air-intake grill, a needle-shaped electrode unit connecting plural discharge needles with shapes accommodated in the groove, an L-shaped bend serving as a high-voltage power receiving terminal of the needle-shaped electrode unit and fitted in a slide projection provided on the edge of the filter unit, a needle-electrode cover for covering the needle-shaped electrode unit fitted in the groove, and a pressing rib provided on the needle-electrode cover. The needle-shaped electrode unit has a dent. The pressing rib contacts the dent of the needle-shaped electrode unit to fix the needle-electrode cover. This structure fixes the discharge needles accurately without a screw or the like to a predetermined position on the filter unit by simple installation work. This can prevent poor filtering efficiency caused by inaccurate installation work.

Exemplary Embodiment 4

Figure 22:
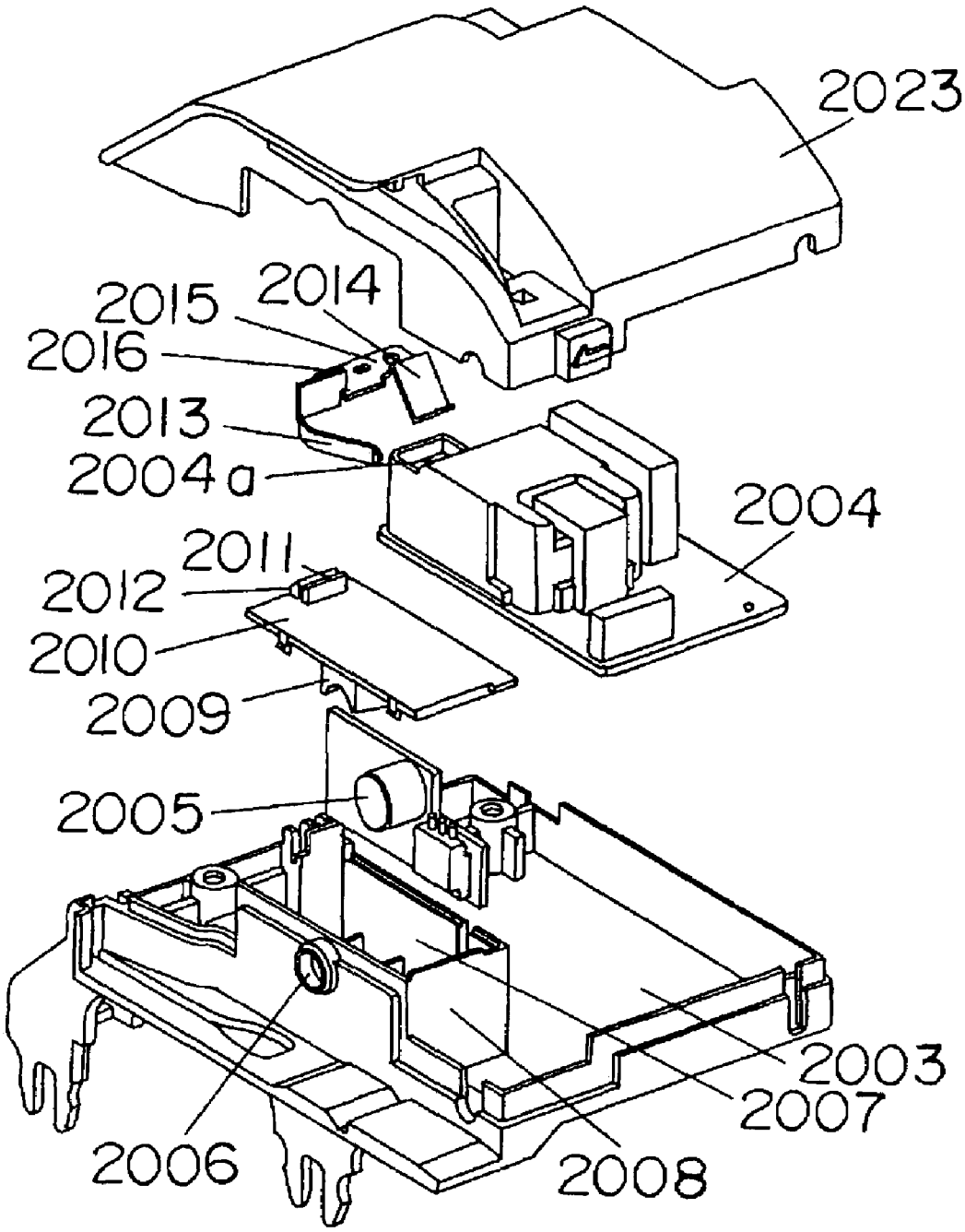
FIG. 22 is an exploded perspective view of an electric dust collector of Exemplary Embodiment 4 of the invention.
Figure 23:
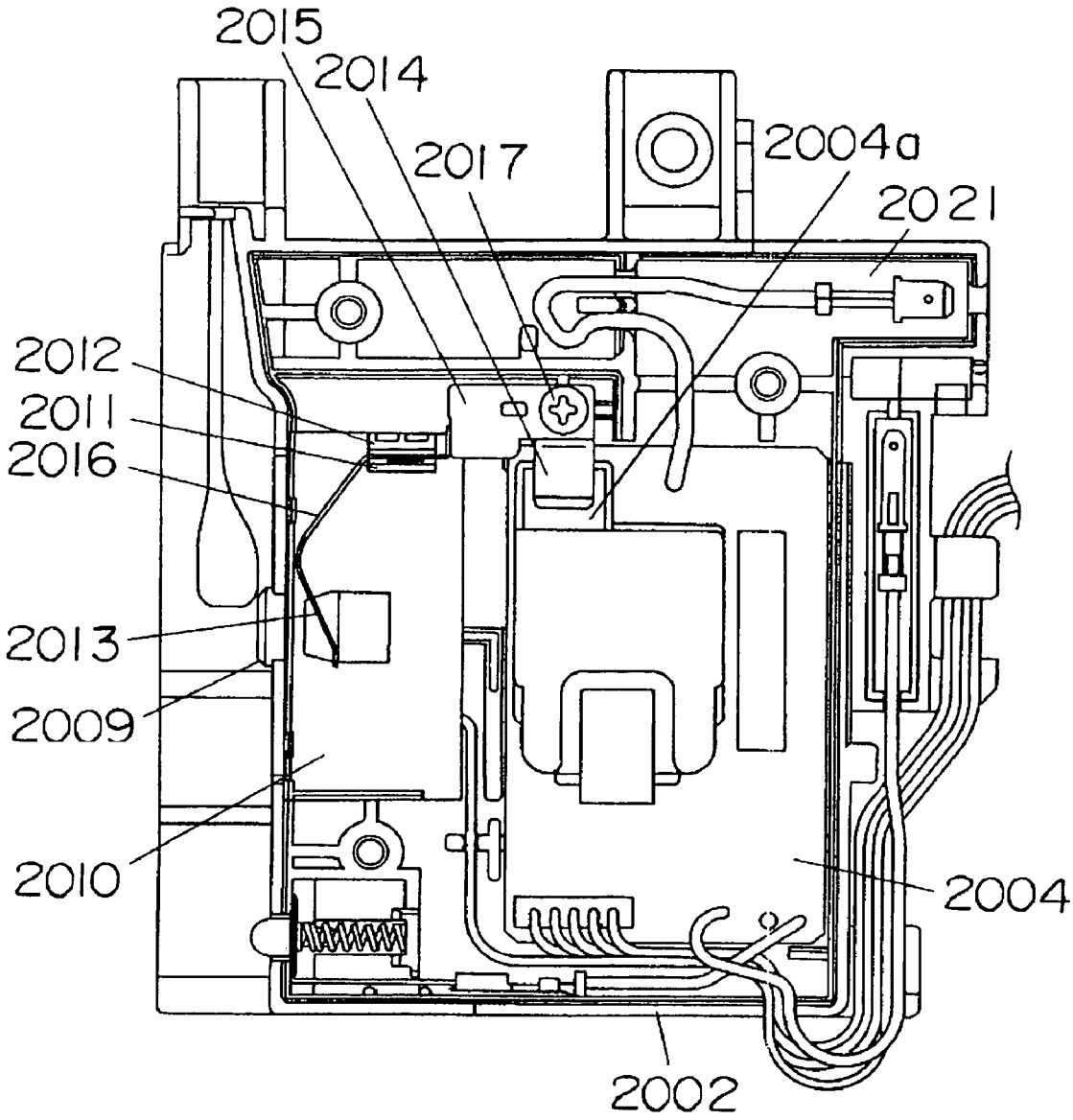
FIG. 23 is a plan view of the electric dust collector of Embodiment 4.
Figure 24:
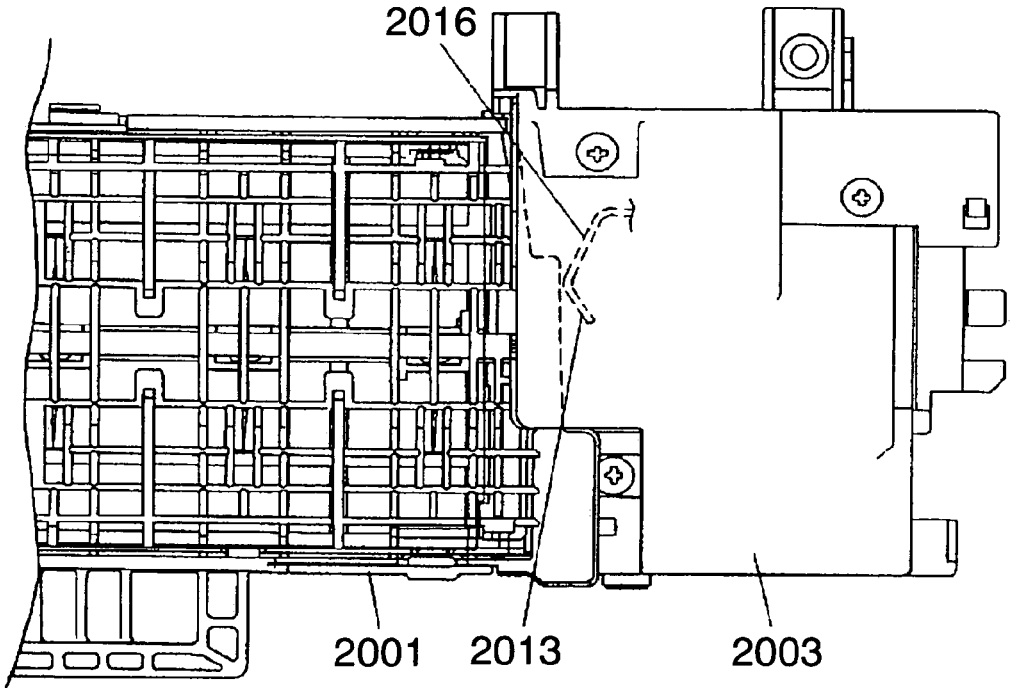
FIG. 24 is a plan view of the electric dust collector of Embodiment 4.
Figure 25:
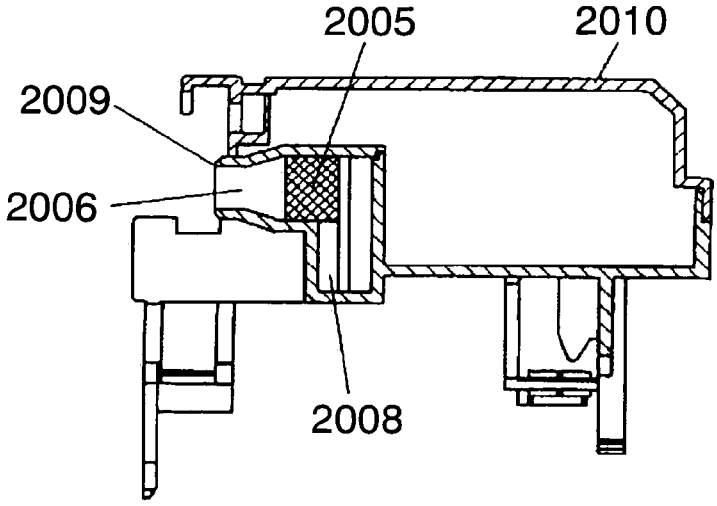
FIG. 25 is a section view of the electric dust collector of Embodiment 4.
Figure 26:
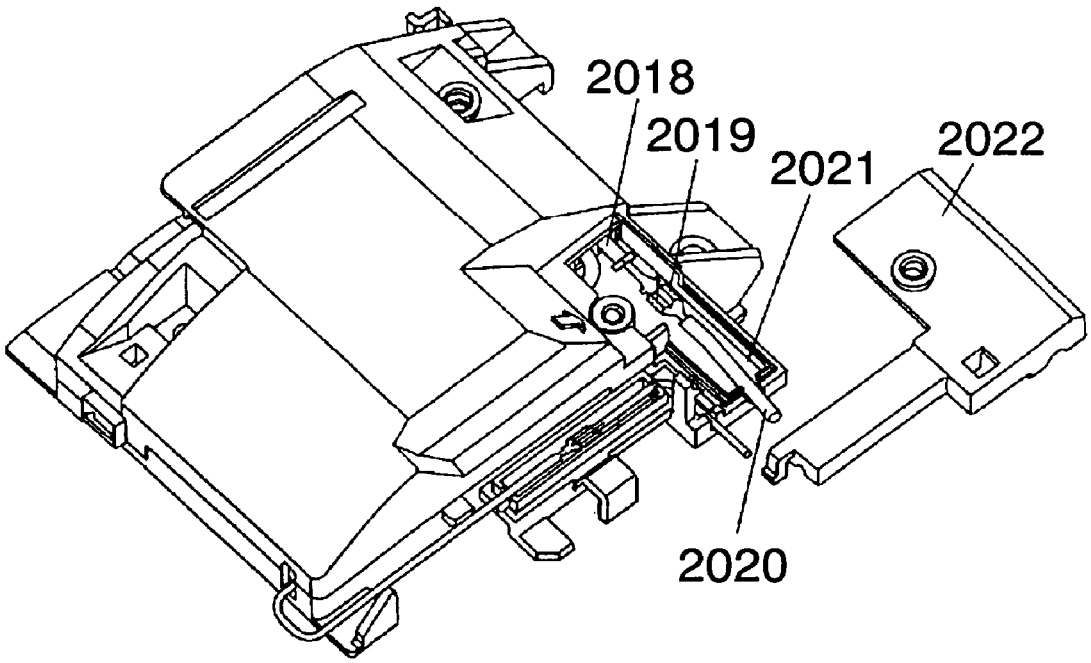
FIG. 26 is a perspective view of the electric dust collector of Embodiment 4.

FIG. 22 is an exploded perspective view of an electric dust collector of Exemplary Embodiment 4 of the present invention. FIG. 23 is a plan view of the electric dust collector of Embodiment 4. FIG. 24 is a plan view of the electric dust collector of Embodiment 4. FIG. 25 is a section view of the electric dust collector of Embodiment 4. FIG. 26 is a perspective view of the electric dust collector of Embodiment 4.

As shown in FIG. 22 to FIG. 26, the electric dust collector has filter unit 2001 and holding unit 2002 on which filter unit 2001 is mounted, and includes electrical box 2003 provided on an end of holding unit 2002, high-voltage power supply board 2004 and ultrasonic wave oscillator 2005 in electrical box 2003, opening 2006 in a side wall for passing ultrasonic wave generated from ultrasonic wave oscillator 2005, Accommodating chamber 2008 having top-opening 2007, tubular projection 2009 that surrounds ultrasonic wave oscillator 2005, and lid 2010 for chamber 2008. Having a diameter smaller toward opening 2007, tubular projection 2009 is vertically divided in two; one is provided in chamber 2008, and the other is provided inside lid 2010 that covers opening 2007 of chamber 2008. Chamber 2008 is covered with lid 2010, providing tubular projection 2009 in chamber 2008.

The electric dust collector includes bracket holder 2012 having groove 2011, and high-voltage power supply bracket. 2016. Bracket holder 2012 with groove 2011 is provided on the top surface of lid 2010 of chamber 2008 that accommodates ultrasonic wave oscillator 2005. High-voltage power feeding terminal 2013 is provided on one end; and high-voltage power connector 2014 is provided on the other end of high-voltage power supply bracket 2016. High-voltage power feeding terminal 2013 has a bent structure so as to provide an elastic force in a horizontal direction to filter unit 2001 and so as to fit with groove 2011 of bracket holder 2012. At the other end of bracket 2016, high-voltage power connector 2014 is bent so as to contact power supply terminal 2004*a* of high-voltage power supply board 2004 with the elastic force. In the middle of bracket 2016, rigid holding section 2015 is provided. Contacting lid 2010 of chamber 2008, high-voltage power feeding bracket 2016 is fixed to electrical box 2003 with screw 2017. The end having high-voltage power feeding terminal 2013 is retained by lid 2010 of chamber 2008. High-voltage power connector 2014 is provided so as to have an intimate contact with high-voltage power supply board 2004.

The electric dust collector includes lead-out wire 2018 extending from high-voltage power supply board 2004 and connecting line 2020 connected from outside electrical box 2003 to lead-out wire 2018 via connecting terminal 2019. Wires 2018 and 2020 are accommodated in small chamber 2021 in electrical box 2003 so as to be fed with high-voltage power supply. The opening of small chamber 2021 is closed with small-chamber lid 2022. Electrical box 2003 contains high-voltage power supply bracket 2016 having high-voltage power feeding terminal 2013 and high-voltage power connector 2014, high-voltage power supply board 2004, and electrical-box lid 2023 that covers the top of electrical box 2003.

In the structure above, a high-voltage power supply which is transformed from commercial power supply at high-voltage power supply board 2004 is supplied from high-voltage terminal 2004*a* to high-voltage power connector 2014 of high-voltage power supply bracket 2016, and further, is supplied to filter unit 2001 through high-voltage power feeding terminal 2013 provided on the other end of high-voltage power supply bracket 2016. At this moment, the high-voltage power supply is supplied to the main unit (not shown) to drive a negative ions generator or the like through lead-out wire 2018, connecting terminal 2019, and connecting line 2020.

According to the structure of Embodiment 4, the electric dust collector has filter unit 2001 and holding unit 2002 on which filter unit 2001 is mounted, and includes electrical box 2003 provided on an end of holding unit 2002, high-voltage power supply board 2004 and ultrasonic wave oscillator 2005 in electrical box 2003. Ultrasonic wave oscillator 2005 is accommodated in top-open chamber 2008. Opening 2007 is closed with lid 2010. Disposing high-voltage power supply board 2004 and ultrasonic wave oscillator 2005 in electrical box 2003 can shorten the wiring length, enhancing efficiency in workability and transportation. Besides, the structure not only contributes to a downsized electric dust collector, but also protecting the ultrasonic wave oscillator an other components from collecting dust that can cause deterioration of ultrasonic wave radiation.

The electric dust collector includes bracket holder 2012, and high-voltage power supply bracket 2016. Bracket holder 2012 is provided on the top surface of lid 2010 of chamber 2008 that accommodates ultrasonic wave oscillator 2005. High-voltage power feeding terminal 2013 held by bracket holder 2012 is provided on one end of high-voltage power supply bracket 2016. At the other end of bracket 2016, high-voltage power connector 2014 is provided. High-voltage power connector 2014 contacts power supply terminal 2004*a* of high-voltage power supply board 2004. High-voltage power supply bracket 2016 is fixed in electrical box 2003 so that the midsection of high-voltage power supply bracket 2016 contacts lid 2010 of chamber 2008. High-voltage power connector 2014 is provided so as to have an intimate contact with high-voltage power supply board 2004. High-voltage power supply bracket 2016 is fixed adjacent to lid 2010 of chamber 2008 that accommodates ultrasonic wave oscillator 2005. Lid 2010 of chamber 2008 is secured through bracket holder 2012 on the side of high-voltage power feeding terminal 2013, and on the other side of high-voltage power supply bracket 2016, high-voltage power connector 2014 has an intimate contact with high-voltage power supply board 2004. This structure can fix lid 2010 and high-voltage power supply bracket 2016 simultaneously, thereby increasing workability and decreasing parts count.

High-voltage power connector 2014 which has high-voltage power supply brackets 2016 provided at its both ends and high-voltage power feeding terminal 2013 have elasticity. Holder section 2015 provided at the middle to be fixed with screw 2017 has rigidity. High-voltage power supply bracket 2016 is formed by bending a conductive metal plate, thus provided by bending a single metal plate. This structure provides high-voltage power connector 2014 and high-voltage power feeding terminal 2013 with no use of plural materials, thereby reducing cost. This provides a structure having a small occupied area, secure fixing, and properly positioned contact points.

In order to feed ultrasonic wave generated from ultrasonic wave oscillator 2005 to filter unit 2001, opening 2006 is provided chamber 2008. Tubular projection 2009 is formed of chamber 2008 and lid 2010 so as to surround ultrasonic wave oscillator 2005 and so as to face opening 2006. Ultrasonic wave, which is radiated from ultrasonic wave oscillator 2005, is led by tubular projection 2009 through opening 2006 of chamber 2008 toward filter unit 2001 as a predetermined direction. Besides, tubular projection 2009 is divided in two sections; one is provided on the side of chamber 2008, and the other one is provided on the side of lid 2010. Dividing tubular projection 2009 in two and disposing each section on the sides of chamber 2008 and lid 2010 allows ultrasonic wave oscillator 2005 to be vertically sandwiched between two sections. That is, the structure can not only securely retain ultrasonic wave oscillator 2005 even in small chamber 2008, but also simplify installation work of ultrasonic wave oscillator 2005.

The electric dust collector includes lead-out wire 2018 extending from high-voltage power supply board 2004 and connecting line 2020 connected from outside electrical box 2003 to lead-out wire 2018 via connecting terminal 2019. Small chamber 2021 for surrounding connecting terminal 2019 to prevent dust collection, and small-chamber lid 2022 are provided in electrical box 2003. That is, connecting terminal 2019 that connects between lead-out wire 2018 and connecting line 2020 is located in small chamber 2021 in electrical box 2003. The structure not only eliminates the need for additionally providing insulation for protecting connector 2020, but also prevents dust collection, thereby enhancing safety.

High-voltage power supply bracket 2016 is secured to electrical box 2003 with screws 2017, while high-voltage power connector 2004 of high-voltage power supply bracket 2016 contacts high-voltage power supply board 2004 with pressure, thereby fixing high-voltage power supply board 2004 easily in electrical box 2003. According to Embodiment 4, the electric dust collector includes an electrical box provided on one end of the holding unit on which the filter unit is mounted, and a high-voltage power supply board and an ultrasonic wave oscillator in the electrical box. The ultrasonic wave oscillator is accommodated in a top-open chamber. The opening of the chamber is covered with a lid. The structure can shorten the lengths of wirings, thus contributing to a downsized electric dust collector. Besides, the structure protects the ultrasonic wave oscillator from deterioration of ultrasonic wave radiation.

The electric dust collector includes a bracket holder and a high-voltage power supply bracket. The bracket holder is provided on the top surface of a lid of a chamber that accommodates an ultrasonic wave oscillator. A high-voltage power feeding terminal held by the bracket holder is provided on one end of the high-voltage power supply bracket. At the other end of the high-voltage power supply bracket, a high-voltage power connector is provided. The high-voltage power supply bracket is fixed in the electrical box so as to contact the lid of the chamber. The high-voltage power connector has an intimate contact with the high-voltage power supply board. The structure above can fix the lid and the high-voltage power supply bracket simultaneously, thereby increasing workability and decreasing parts count.

The high-voltage power connector which has high-voltage the power supply brackets provided at its both ends and the high-voltage power feeding terminal have elasticity. The holder section provided at the middle to be fixed with the screw has rigidity. The high-voltage power supply bracket is formed by bending a conductive metal plate, thus provided by bending a single metal plate. This structure provides the high-voltage power connector and the high-voltage power feeding terminal with no use of plural materials, thereby reducing cost. This provides a structure having a small occupied area, secure fixing, and properly positioned contact points.

In an electric dust collector of the embodiment, the chamber has an opening for feeding ultrasonic wave from the ultrasonic wave oscillator to the filter unit. In this case, a tubular projection is formed of the chamber and the lid so as to surround the ultrasonic wave oscillator and face to the opening.

With the structure above, the ultrasonic wave supplied from the ultrasonic wave oscillator is not only guided in a predetermined direction. Besides, the ultrasonic wave oscillator can be securely retained even in the small chamber.

The electric dust collector includes a lead-out wire extending from the high-voltage power supply board, and a connecting line connected from the outside of the electrical box via a connecting terminal. The electrical box has a small chamber surrounding the connecting terminal to prevent dust collection. The structure above not only eliminates the need for additionally providing insulation for protecting the connector, but also preventing dust collection, thereby enhancing safety.

The high-voltage power feeding bracket is fixed to the electrical box, while the high-voltage power connector of the high-voltage power feeding bracket contacts the high-voltage power supply board with pressure. The high-voltage power supply bracket onto the electrical box, allowing the high-voltage power supply board to be easily fixed under pressure in the electrical box.

Exemplary Embodiment 5

Figure 27:
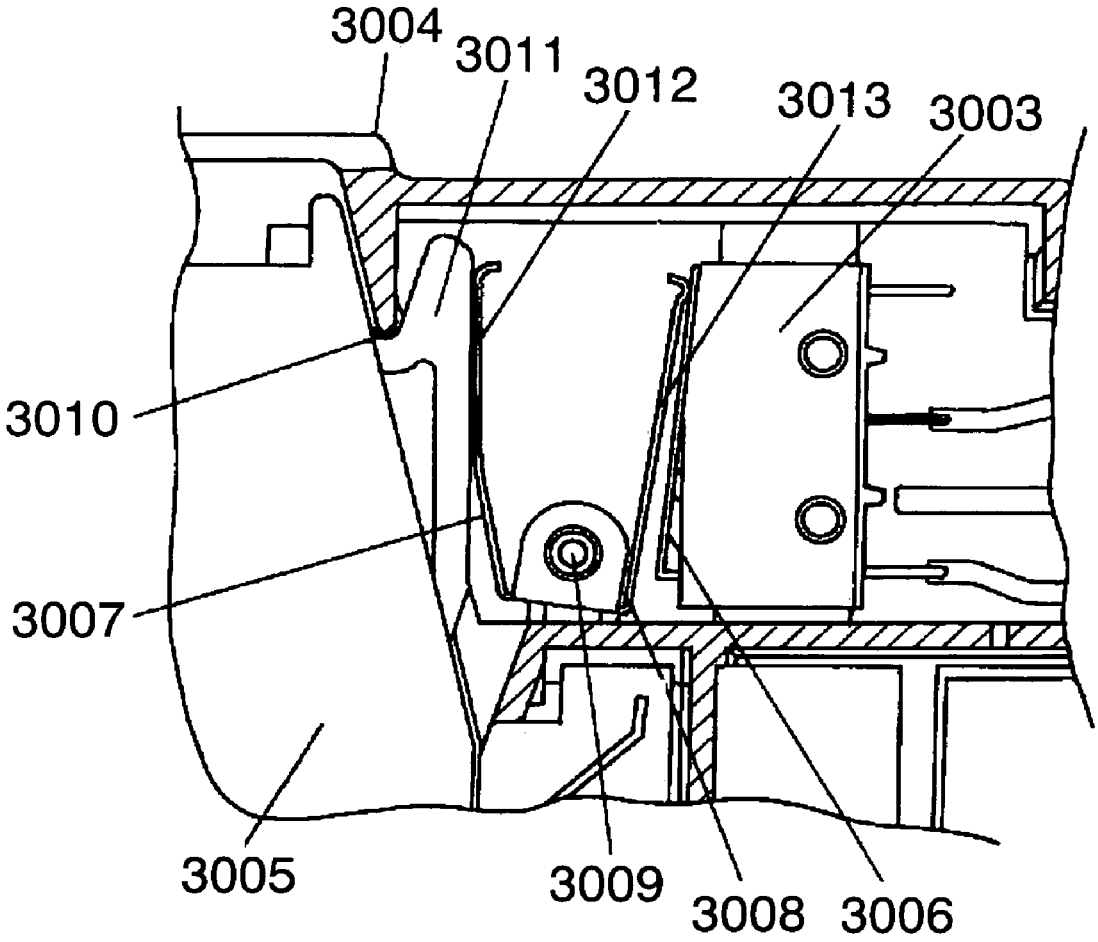
FIG. 27 is a partial view of an electric dust collector of Exemplary Embodiment 5 of the invention.
Figure 28A:
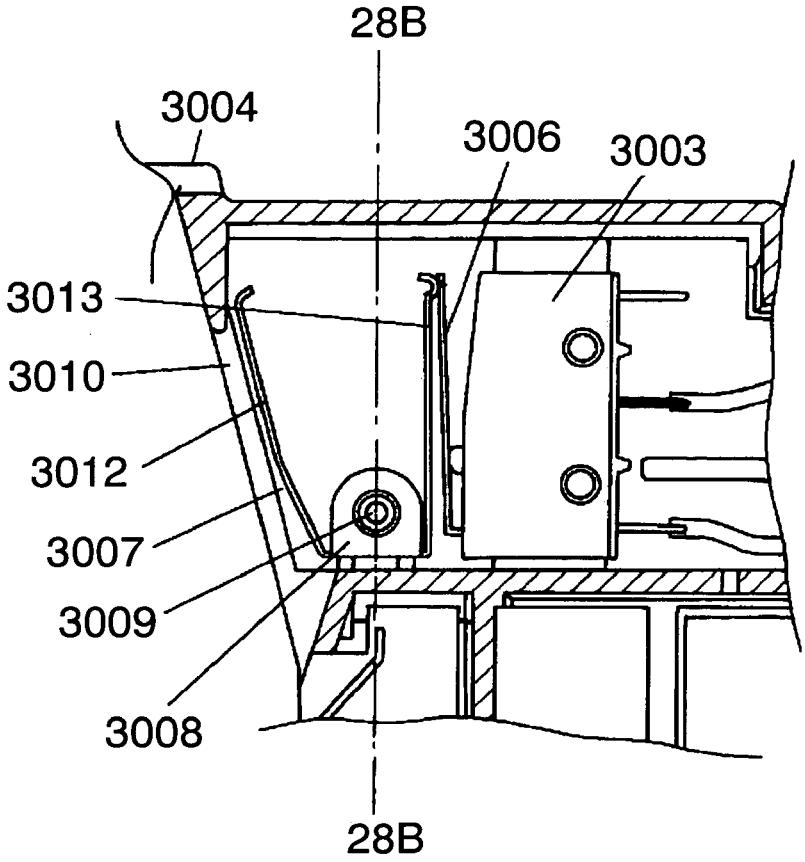
FIG. 28A is a partial view of the electric dust collector of Embodiment 5.
Figure 28B:
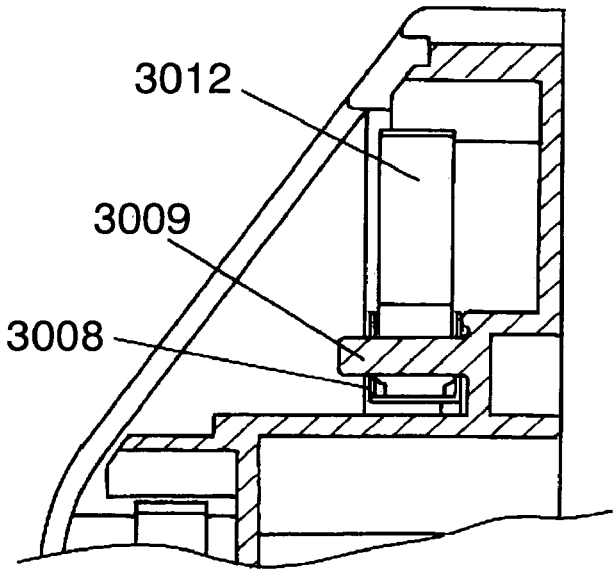
FIG. 28B is a section view of the electric dust collector taken along line 28B-28B shown in FIG. 28A.
Figure 29A:
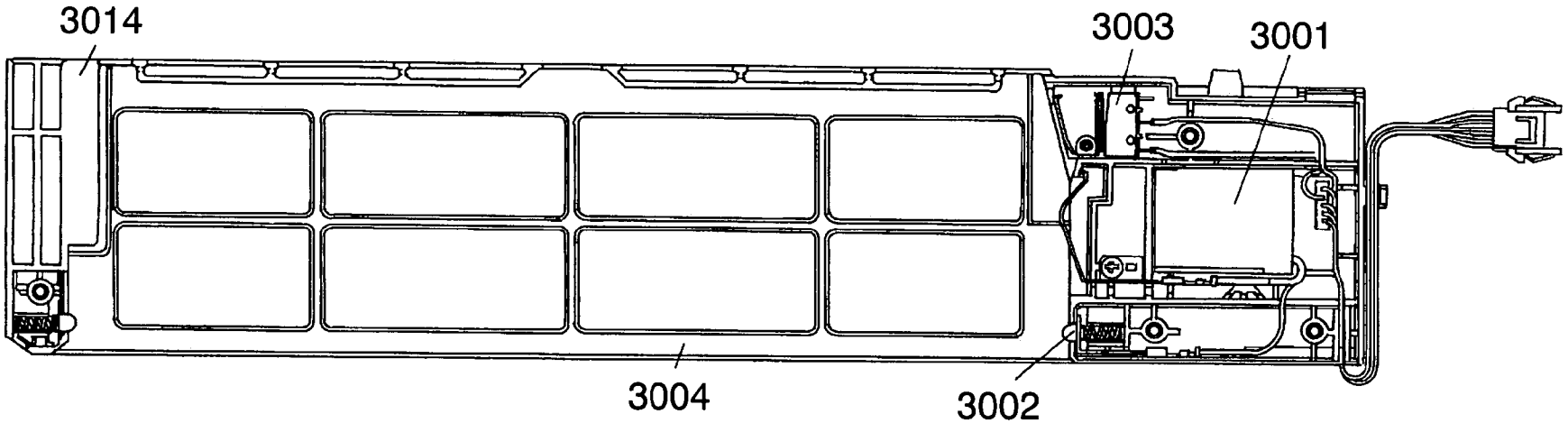
FIG. 29A is a front view of the electric dust collector and a holding unit of Embodiment 5.
Figure 29B:
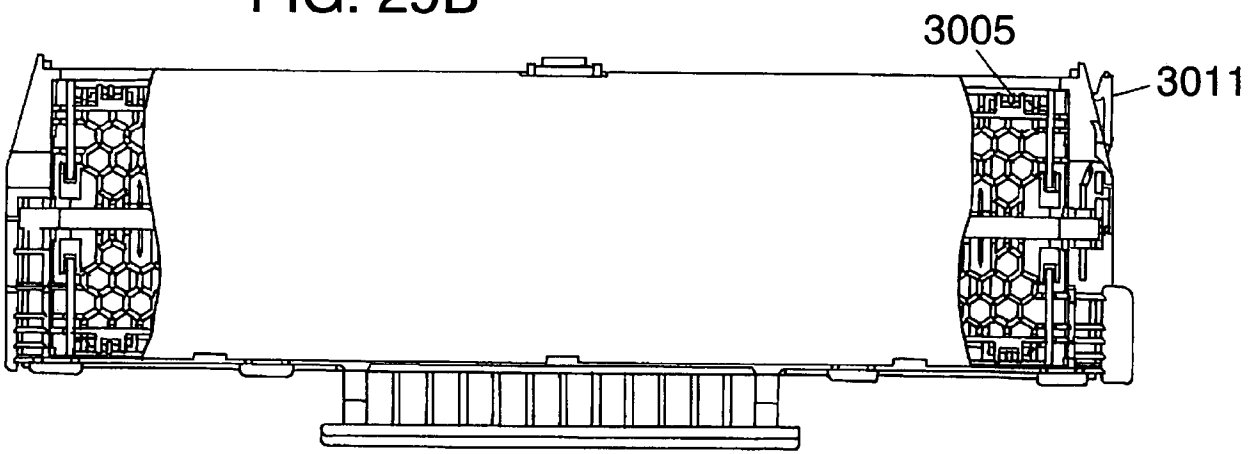
FIG. 29B is a front view of the electric dust collector and the holding unit of Embodiment 5.
Figure 30:
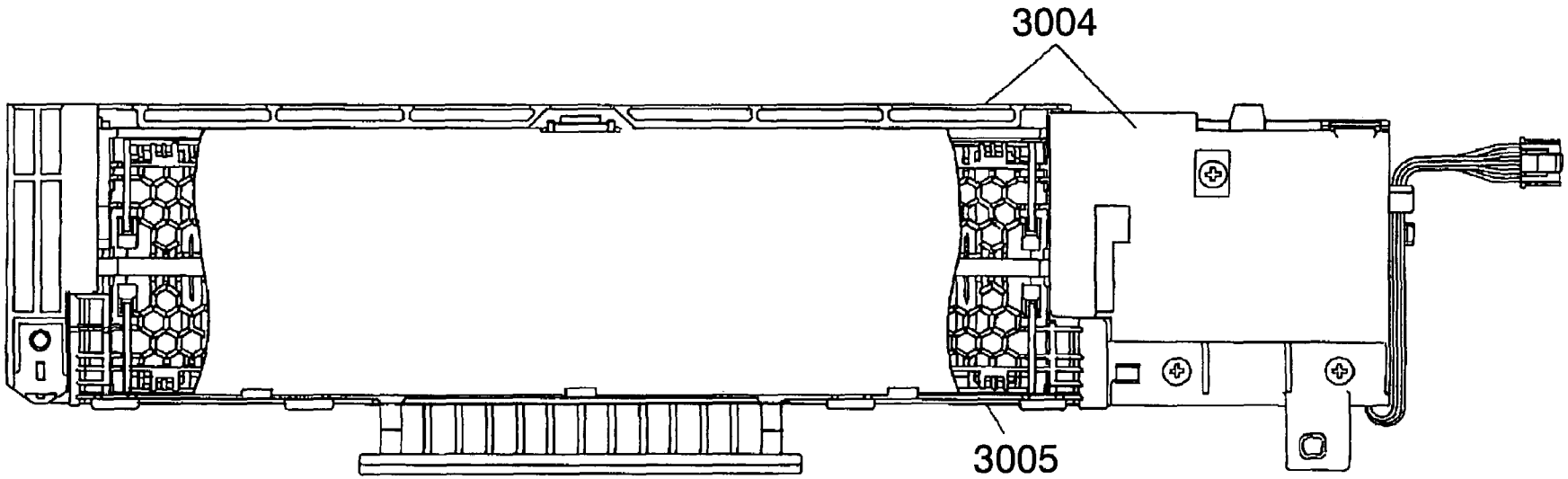
FIG. 30 is a front view of the electric dust collector of Embodiment 5.
Figure 31:
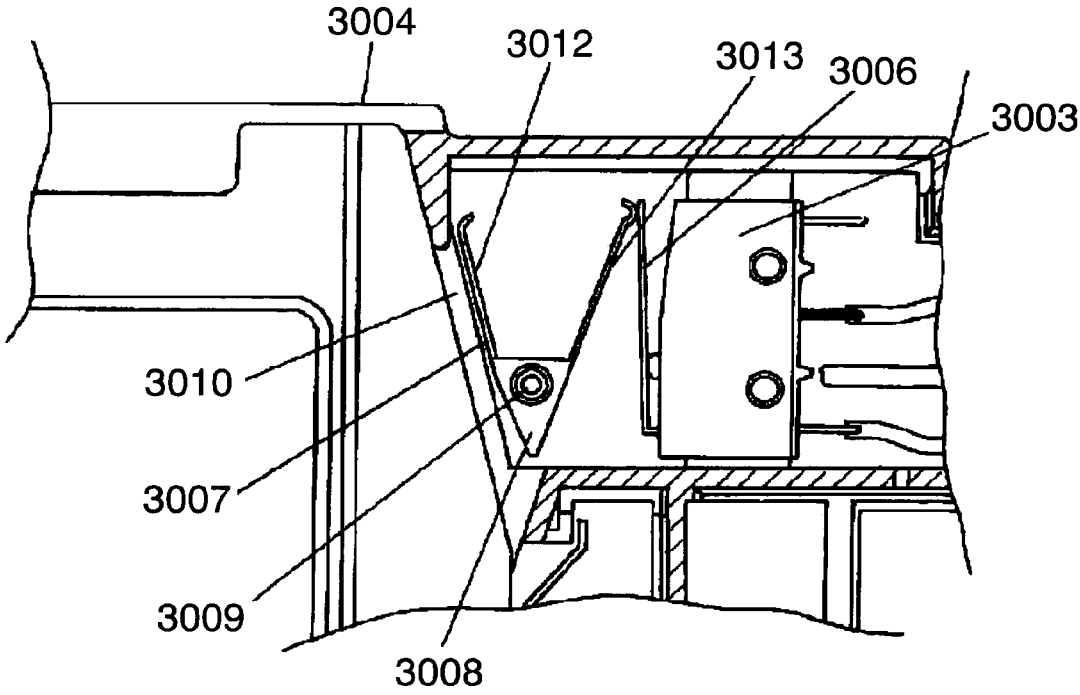
FIG. 31 is a partial view of another electric dust collector of Embodiment 5.

FIG. 27 is a partial view of an electric dust collector according to Exemplary Embodiment 5 of the present invention. FIG. 28A is a partial view of the electric dust collector of Embodiment 5. FIG. 28B is a section view of the electric dust collector at line 28B-28B shown in FIG. 28A. FIG. 29A and FIG. 29B are front views of the electric dust collector and a holding unit of Embodiment 5, respectively. FIG. 30 is a front view of the electric dust collector of Embodiment 5. FIG. 31 is a partial view of another electric dust collector of Embodiment 5.

As shown in FIG. 27 to FIG. 31, in the electric dust collector, holding unit 3004 is provided in an air channel of an air conditioner and the like. A dust-collecting unit is removably mounted on holding unit 3004.

The structure of the embodiment includes limit switch 3003 for turning on and off high-voltage power supply 3001, and folded elastic member 3007 that is bent into U-shape and provided so as to face operation lever 3006 of limit switch 3003. Support rib 3009 engaged with bend 3008 is provided on holding unit 3004. Folded elastic member 3007 having bend 3008 is provided movable in support rib 3009 on holding unit 3004. Switch operation rib 3011 is provided on dust-collecting unit 3005. When dust-collecting unit 3005 is attached to holding unit 3004, switch operation rib 3011 protrudes from opening 3010 of holding unit 3004 to folded elastic member 3007, and pushes rib-side arm 3012 of folded elastic member 3007. As folded elastic member 3007 is tilted by the pushing force, lever-side arm 3013 of folded elastic member 3007 is accordingly tilted in the direction of pushing operation lever 3006 of limit switch 3003.

In the structure above, holding unit 3004 is provided in the air channel of the air conditioner and the like. With an upward movement, dust-collecting unit 3005 is fixed in the inside of holder 3014 provided on holding unit 3004. At this moment, the dust-collecting unit is attached to the holding unit, and switch operation rib 3011 of dust-collecting unit 3005 comes into opening 3010 of holding unit 3004, pushing lever-side arm 3013 of folded elastic member 3007. Folded elastic member 3007 movably provided to support rib 3009 tilts via bend 3008. The tilting causes folded elastic member 3007 to contract inward, and generates repulsion in the outward direction of the arm. As a result, lever-side arm 3013 of folded elastic member 3007 pushes operation lever 3006 of limit switch 3003, and allows high-voltage power supply from high-voltage power supply 3001 to be supplied to dust-collecting unit 3005. Dust collection is thus carried out.

With the structure above, the repulsion generated from the elastically altered elastic member 3007 can accommodate variations in positioning the limit switch or switch operation rib 3011, providing accurate operation of limit switch 3003.

Furthermore, folded elastic member 3007 having a U-shape can accommodate an excessive applying force from switch operation rib 3011, controlling properly operation lever 3006 of limit switch 3003.

Bend 3008 is attached into support rib 3009 provided on holding unit 3004, allows a pushing force to be reliably transmitted to the switching operation.

The same effect can be expected if folded elastic member 3007 of Embodiment 5 is formed to have a V-shape, as shown in FIG. 31.

Exemplary Embodiment 6

Figure 32A:
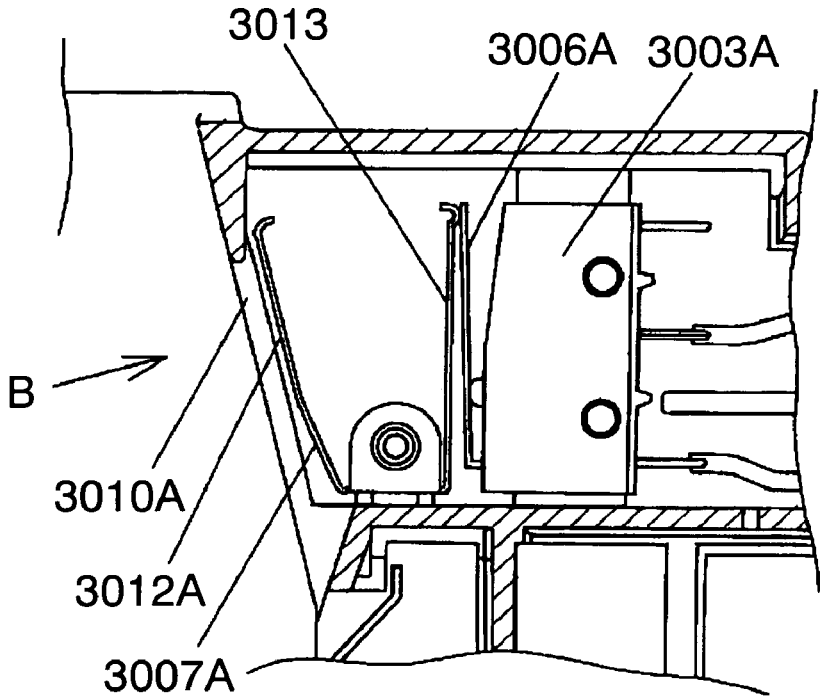
FIG. 32A is a partial view of an electric dust collector of Exemplary Embodiment 6 of the invention.
Figure 32B:
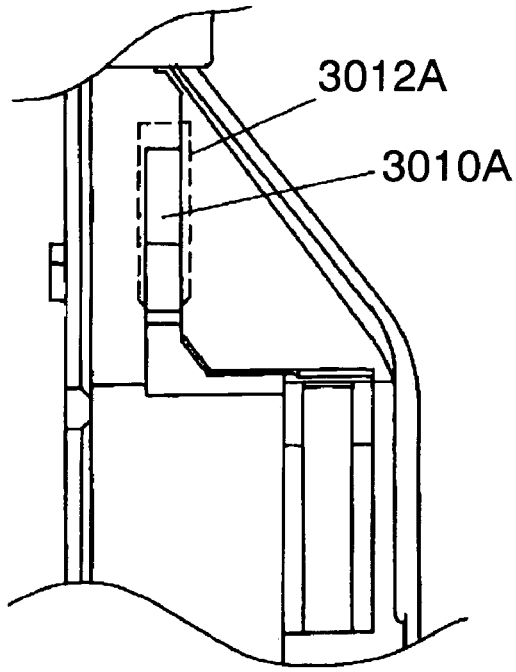
FIG. 32B is a partial view of the electric dust collector of Embodiment 6.
Figure 33:
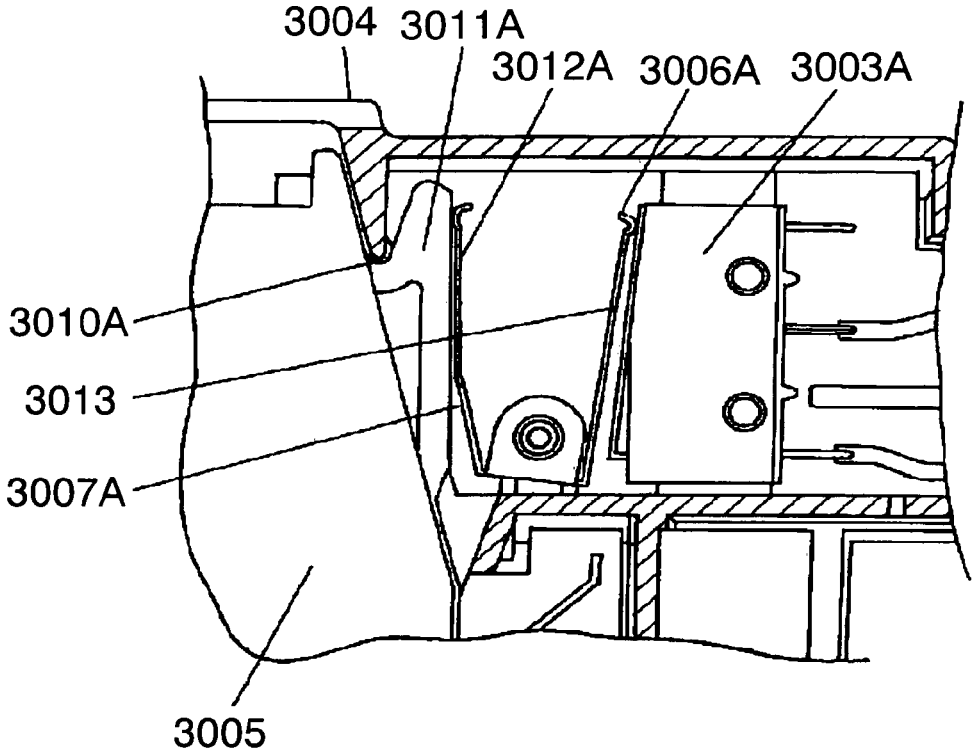
FIG. 33 is a partial view of the electric dust collector of Embodiment 6.

FIG. 32A is a partial view of an electric dust collector according to Exemplary Embodiment 6 of the present invention. FIG. 32B is a partial view of the electric dust collector of Embodiment 6. FIG. 33 is a partial view of the electric dust collector of Embodiment 6.

As shown in FIG. 32A to FIG. 33, rib-side arm 3012A of folded elastic member 3007A that faces switch operation rib 3011A is larger than opening 3010A in which switch operation rib 3011A is inserted on movement. In the structure above, when dust-collecting unit 3005A is mounted on holding unit 3004A, opening 3010A is covered with inserted switch operation rib 3011A.

When dust-collecting unit 3005A is removed from holding unit 3004A, since rib-side arm 3012A is larger than opening 3010A, rib-side arm 3012A of folded elastic member 3007A can cover opening 3010A, reducing dust entry on the side of limit switch 3003A. The structure can protect limit switch 3003A from collecting dust that can invite switching failure.

Exemplary Embodiment 7

Figure 34:
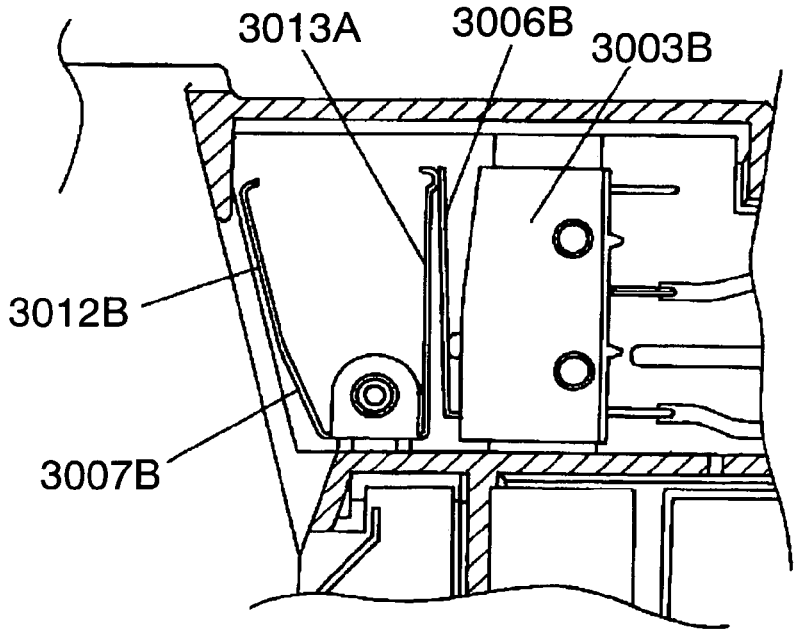
FIG. 34 is a partial view of an electric dust collector of Exemplary Embodiment 7 of the invention.

FIG. 34 is a partial view of an electric dust collector according to Exemplary Embodiment 7 of the present invention. Lever-side arm 3013A of folded elastic member 3007B which faces operation lever 3006B of limit switch 3003B is formed substantially in the same manner as limit switch 3003B.

With the structure above, even if dust comes inside rib-side arm 3012B of folded elastic member 3007B, lever-side arm 3013A, since being formed substantially the same as limit switch 3003B, can prevent the dust from entering in the side of limit switch 3003B. The structure can protect limit switch 3003B from collecting dust that can invite switching failure, providing the switching operation with accuracy.

Exemplary Embodiment 8

Figure 35:
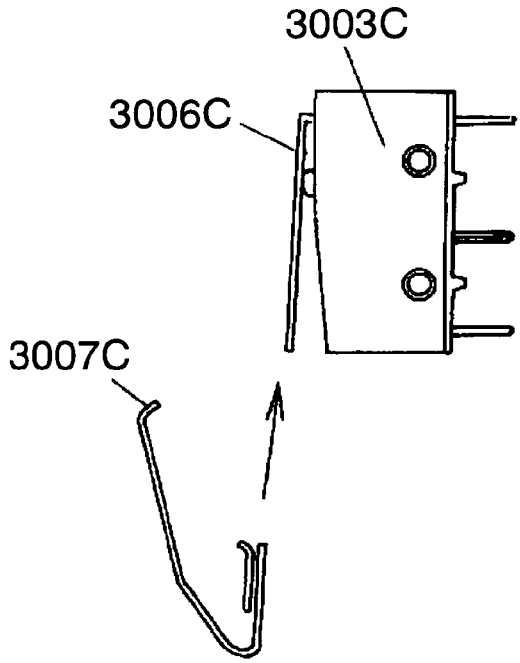
FIG. 35 is a front view of an electric dust collector of Exemplary Embodiment 8 of the invention.
Figure 36:
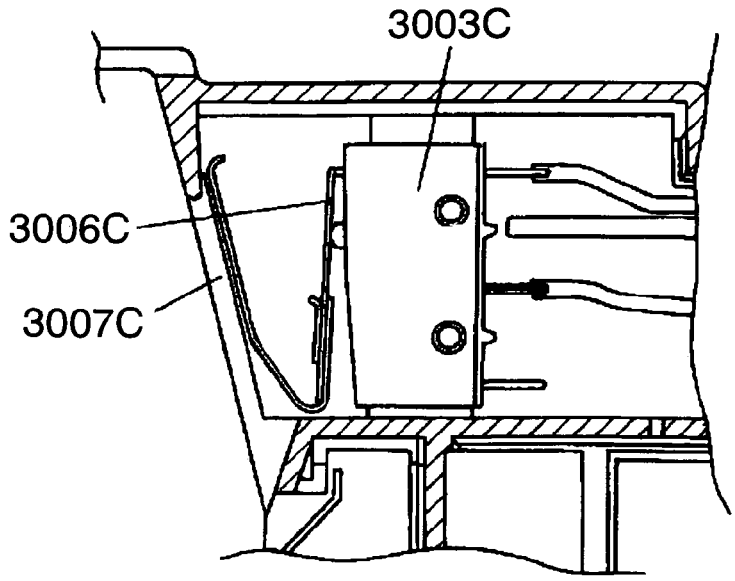
FIG. 36 is a partial view of the electric dust collector of Embodiment 8.

FIG. 35 is a front view of an electric dust collector according to Exemplary Embodiment 8 of the present invention. FIG. 36 is a partial view of the electric dust collector of Embodiment 8.

As shown in FIG. 35 and FIG. 36, folded elastic member 3007C is fitted in the end of operation lever 3006C so as to work as an integral structure.

In the structure above, when folded elastic member 3007C deforms with a pushing force applied from the switch operation rib (not shown), repulsion is generated by the deforming of folded elastic member 3007C. The repulsion is smoothly applied to operation lever 3006C attached with folded elastic member 3007C so as to turn on limit switch 3003C. In addition, limit switch 3003C and folded elastic member 3007C may be formed in one piece, simplifying assembling work and management of parts inventories.

Exemplary Embodiment 9

Figure 37:
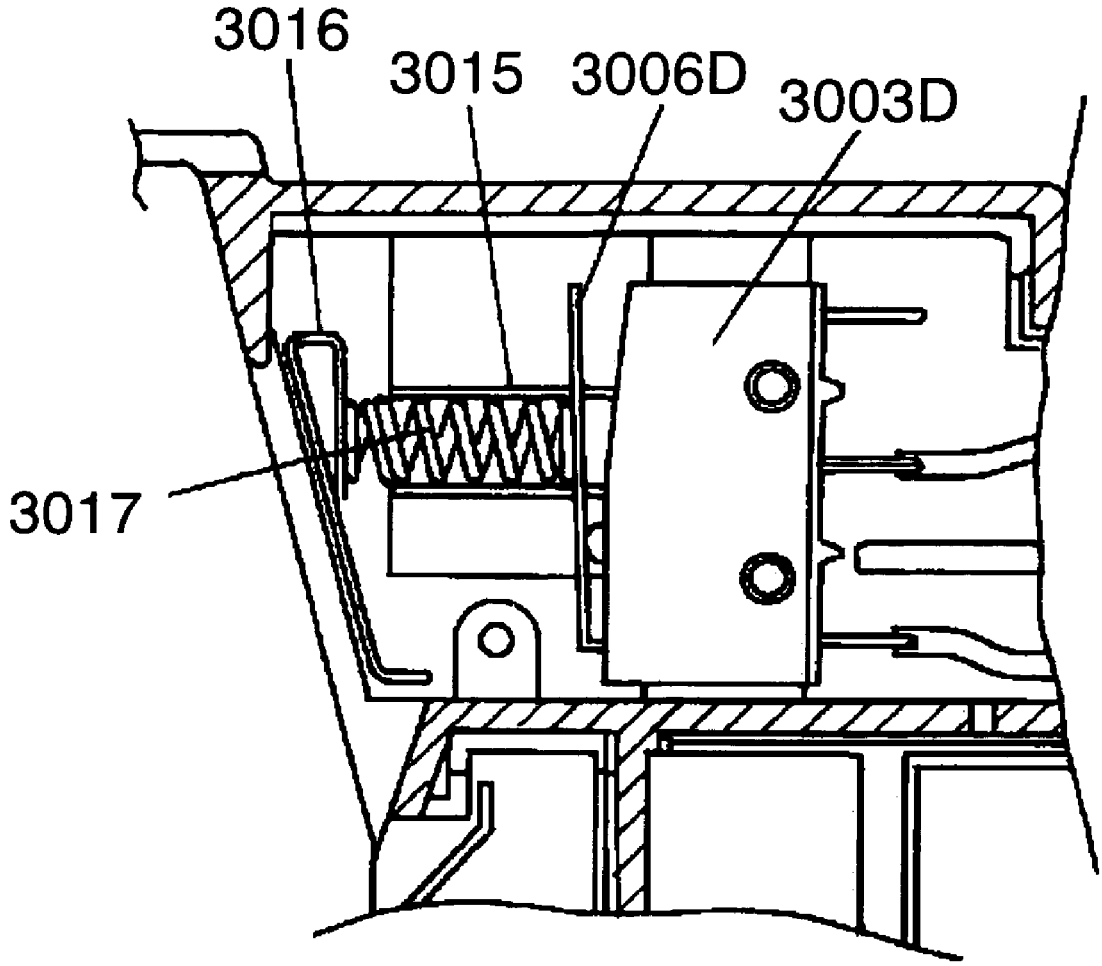
FIG. 37 is a partial view of an electric dust collector of Exemplary Embodiment 9 of the invention.

FIG. 37 is a partial view of an electric dust collector according to Exemplary Embodiment 9 of the present invention. Holder 3015 is provided on limit switch 3003D having coil spring 3017 therein as an elastic member is inserted. Pressed section 3016 pressed with the switch operation rib (not shown) is provided at one end of coil spring 3017.

The other end of coil spring 3017 contacts operation lever 3006D of limit switch 3003D so that an elastic force of coil spring 3017 is applied to operation lever 3006D of limit switch 3003D.

In the structure above, when the switch operation rib pushes pressed section 3016 provided at one end of coil spring 3017, the pressing force contracts coil spring 3017. The contraction produces repulsion that moves operation lever 3006D to turn on limit switch 3003D. The structure can absorb variations in positional relationship between limit switch 3003D and the switch operation rib, providing accurate operation of limit switch 3003D. The a small component, i.e., coil spring 3017, provides space-saving installation.

Exemplary Embodiment 10

Figure 38:
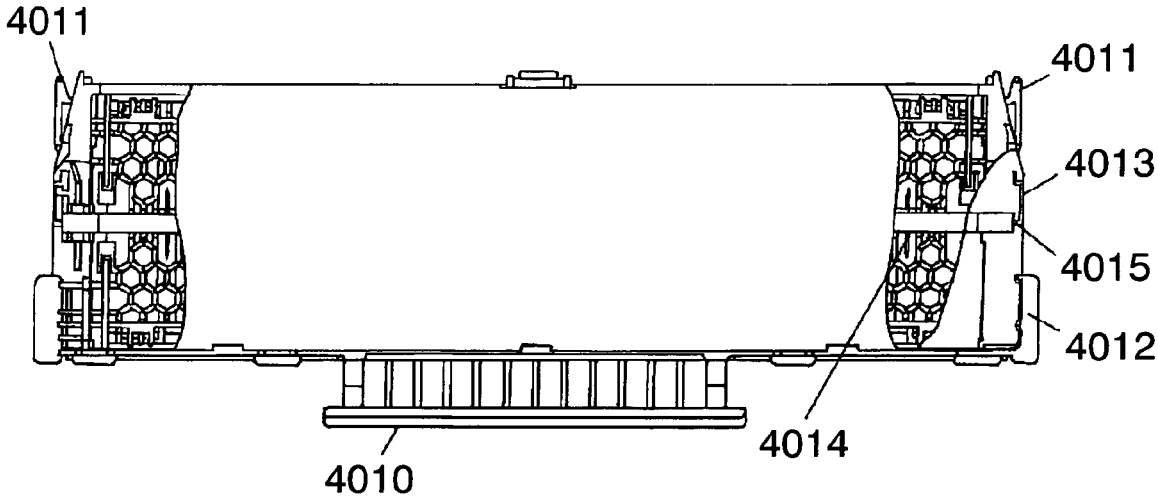
FIG. 38 is a front view of a dust-collecting unit of an electric dust collector of Exemplary Embodiment 10 of the invention.
Figure 39:
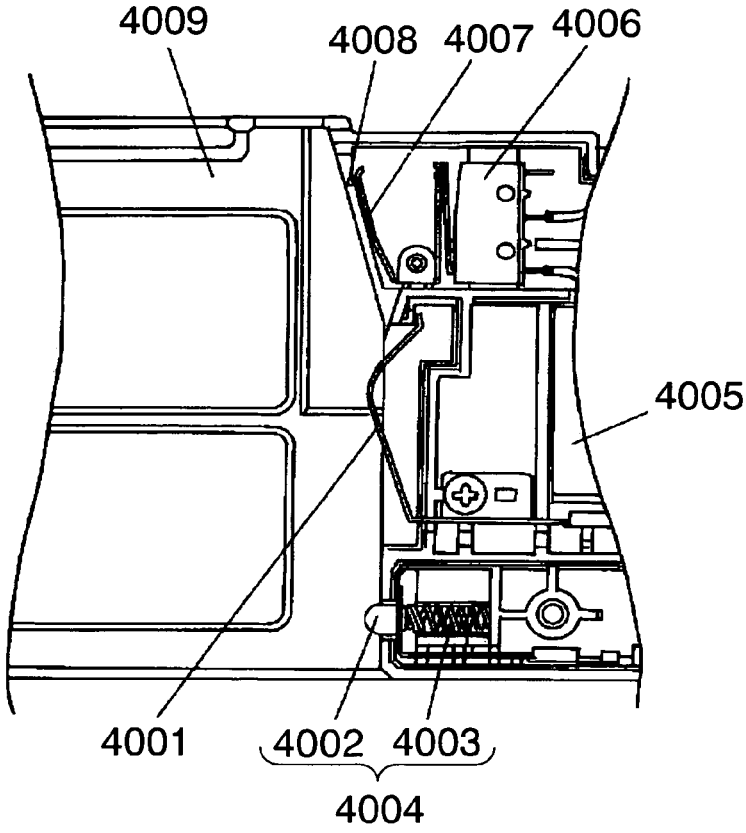
FIG. 39 is a partial view of the electric dust collector and the holding unit of Embodiment 10.
Figure 40:
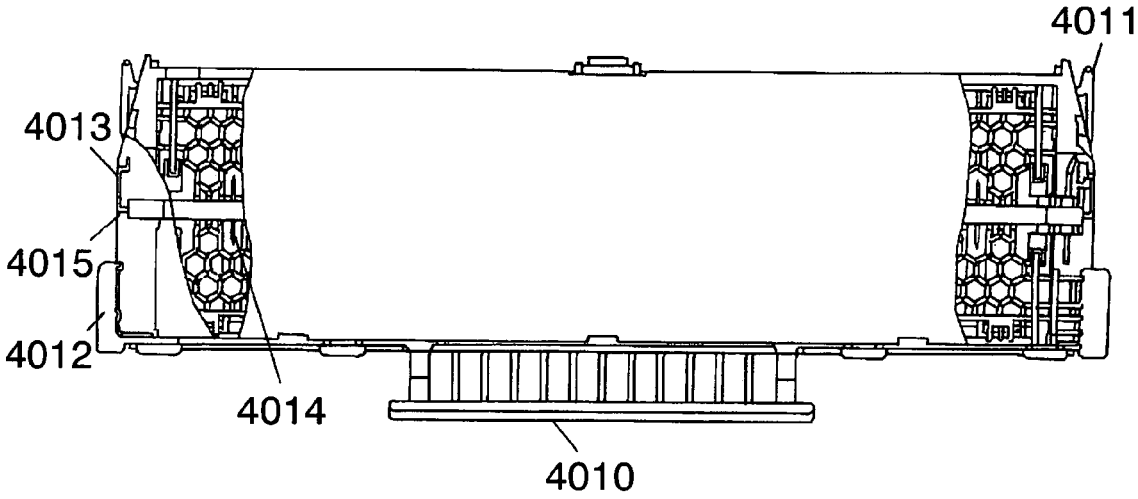
FIG. 40 is a front view of the electric dust collector of Exemplary Embodiment 10.
Figure 41:
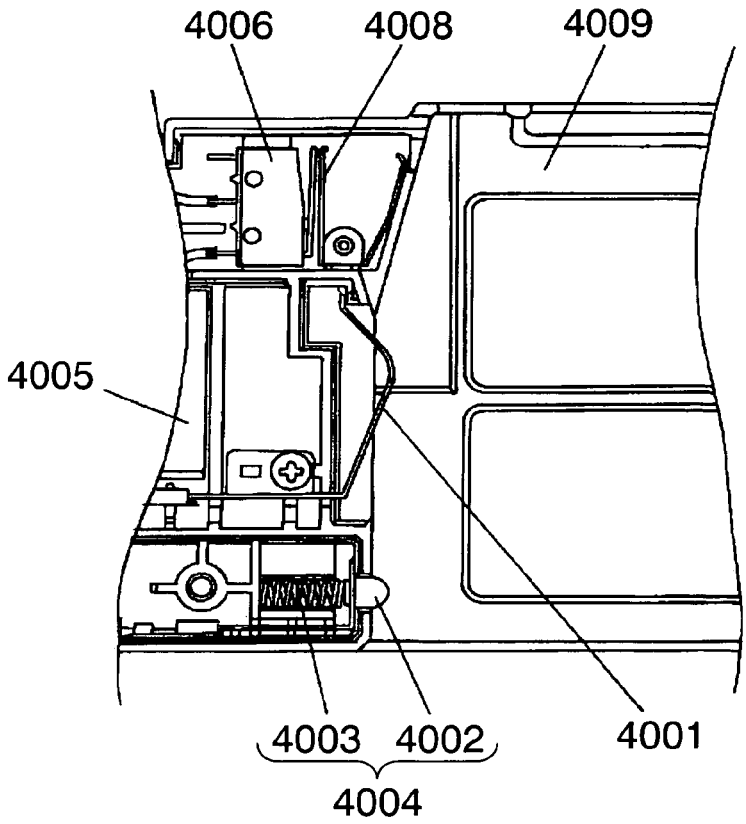
FIG. 41 is a partial view of the electric dust collector and the holding unit of Embodiment 10.

FIG. 38 is a front view of a dust-collecting unit of an electric dust collector according to Exemplary Embodiment 10 of the present invention. FIG. 39 is a partial view of a holding unit of the electric dust collector of Embodiment 10. FIG. 40 is a front view of the electric dust collector of Embodiment 10. FIG. 41 is a partial view of the holding unit of the electric dust collector of Embodiment 10.

As shown in FIG. 38 to FIG. 41, holding unit 4009 is provided in an air channel of an air conditioner and the like, and dust-collecting unit 4010 is removably mounted on holding unit 4009. The structure of the embodiment includes flat spring-like high-voltage power feeding terminal 4001, ground connecting terminal 4004, limit switch 4006 for connecting and disconnecting the high-voltage power supply circuit, and switching unit 4008 on the inner side of holding unit 4009. Ground connecting terminal 4004 has spherical head 4002 and coil spring 4003. Limit switch 4006 which connects and disconnects the high-voltage power supply circuit is controlled by switching unit 4008 formed of folded elastic member 4007.

Dust-collecting unit 4010 has a substantially symmetric shape in which its both sides have respective switch operation rib 4011 for activating switching unit 4008 of limit switch 4006. Ground terminal 4012, high-voltage power receiving terminal 4013, limit switch 4006, and folded elastic member 4007 can be provided on either side of holding unit 4009.

Dust-collecting unit 4010 includes needle-shaped electrode plate 4015 having plural needle-shaped electrodes 4014. Needle-shaped electrode plate 4015 is electrically connected to high-voltage power receiving terminal 4013. The structure of the embodiment further includes a filter (not shown) for collecting dust that is ionized by the application of high voltage.

When high-voltage power feeding terminal 4001 and ground connecting terminal 4004 are located on the right of holding unit 4009, as shown in FIG. 39, dust-collecting unit 4010 is so structured that ground terminal 4012 and high-voltage power receiving terminal 4013 are fixed on the right side of dust-collecting unit 4010, as shown in FIG. 38. When dust-collecting unit 4010 is mounted on holding unit 4009, switching unit 4008 activated with switch operation rib 4011 turns limit on switch 4006, and simultaneously, high-voltage power feeding terminal 4001 and ground connecting terminal 4004 provided on holding unit 4009 are electrically connected to high-voltage power receiving terminal 4013 and ground terminal 4012 provided on dust-collecting unit 4010, respectively, thus providing dust collecting operation.

When high-voltage power feeding terminal 4001 and ground connecting terminal 4004 are located on the left side of holding unit 4009, as shown in FIG. 41, dust-collecting unit 4010 is so structured that ground terminal 4012 and high-voltage power receiving terminal 4013 are fixed on the left side of dust-collecting unit 4010, as shown in FIG. 40. In this way, dust collecting is carried out in the same manner as the aforementioned structure having the high-voltage power feeding terminal and the ground connecting terminal on the right side.

That is, regardless of the locations that the high-voltage power supply with high-voltage power feeding terminal 4001 and ground connecting terminal 4004 is provided on the right or the left of holding unit 4009, dust-collecting unit 4010 is adaptable for holding unit 4009 by replacing the fixing position of high-voltage power receiving terminal 4013 and ground terminal 4012 on dust-collecting unit 4010. The structure of the embodiment provides dust-collecting unit 4010 that can be used commonly with differently structured holding units.

Exemplary Embodiment 11

Figure 42:
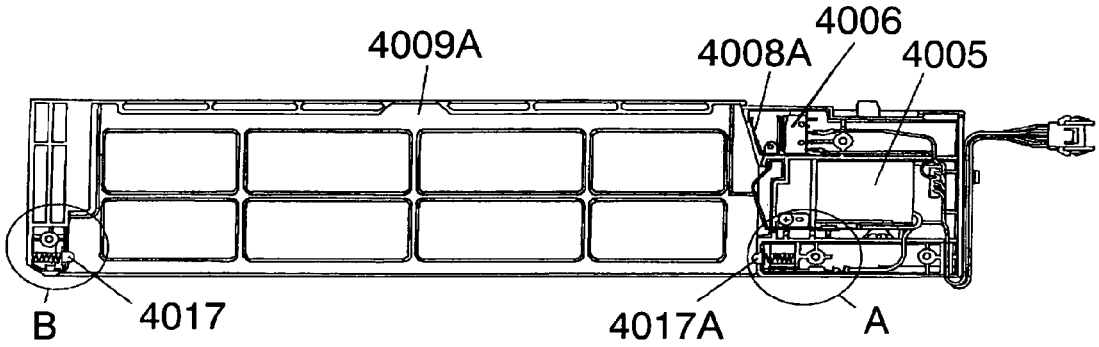
FIG. 42 is a front view of a holding unit of an electric dust collector of Exemplary Embodiment 11 of the invention.
Figure 43:
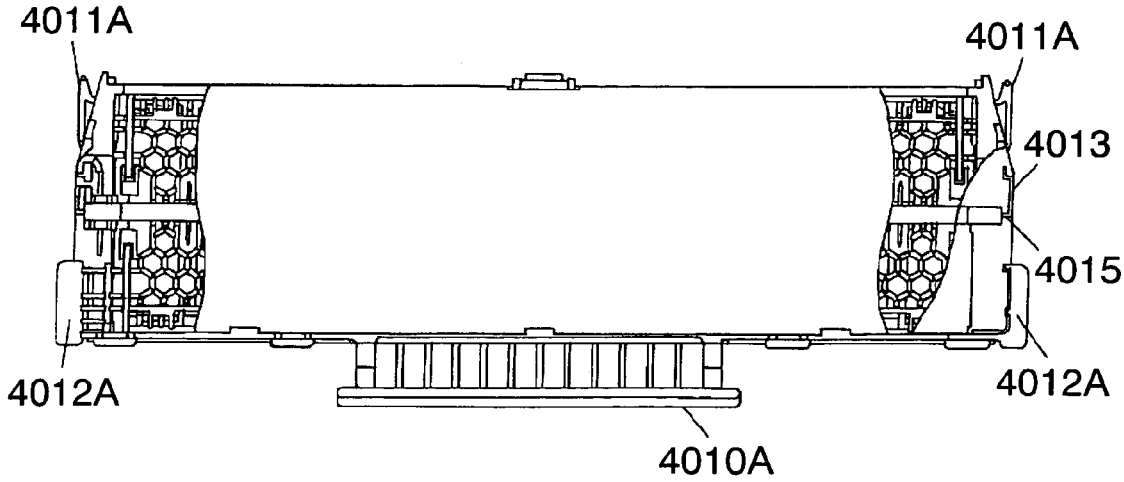
FIG. 43 is a front view of a dust-collecting unit of the electric dust collector of Embodiment 11.
Figure 44:
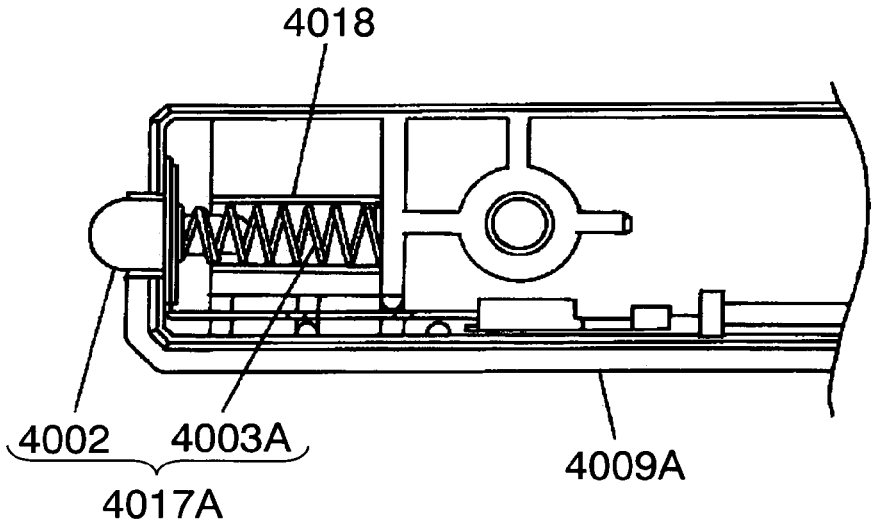
FIG. 44 is an enlarged view of the electric dust collector shown in FIG. 42.
Figure 45:
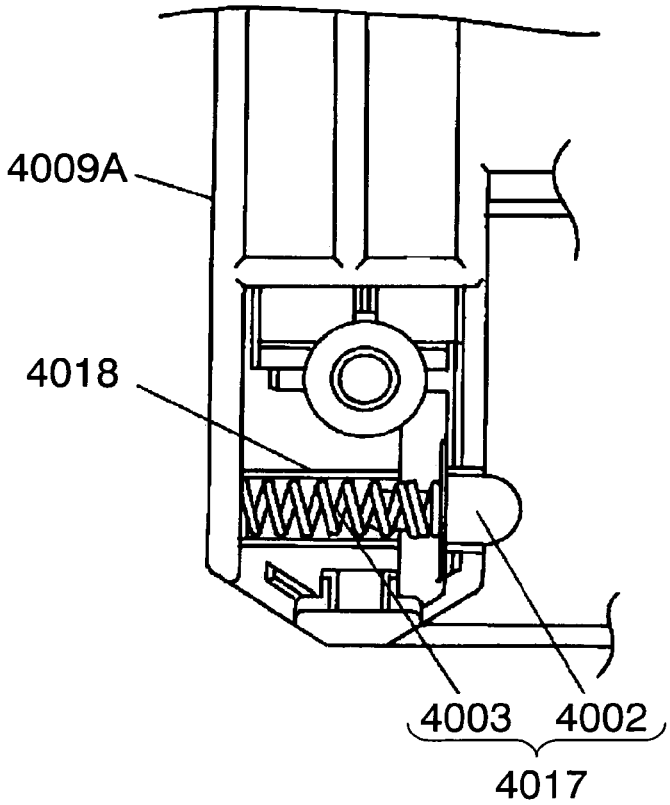
FIG. 45 is an enlarged view of the electric dust collector shown in FIG. 42.

FIG. 42 is a front view of a holding unit of an electric dust collector according to Exemplary Embodiment 11 of the present invention. FIG. 43 is a front view of a dust-collecting unit of the electric dust collector of Embodiment 11. FIG. 44 is an enlarged view of the electric dust collector shown in FIG. 42. FIG. 45 is an enlarged view of the electric dust collector shown in FIG. 42.

As shown in FIG. 42 to FIG. 45, switch operation rib 4011A for activating switching unit 4008A of the high-voltage power supply circuit is provided on dust-collecting unit 4010A. A pair of drop-guard supporters 4017 and 4017A for holding dust-collecting unit 4010A is provided on the wall surface on which dust-collecting unit 4010A is mounted. Drop-guard supporter 4017A provided on one side functions as a ground connecting terminal. Drop-protection supporter 4017 has spherical head 4002 and coil spring 4003 that pushes head 4002. Drop-guard supporter 4017A has head 4002 and coil spring 4003A that pushes head 4002. Coil springs 4003 and 4003A are accommodated in housing 4018. Drop-guard supporter 4017A is formed so as to have a bearing power different from the other drop-guard supporter by changing shape (e.g. diameter) or material—selecting a hard wire or a soft wire with a small elasticity of coil spring 4003A. According to the embodiment, drop-guard supporter 4017A is structured so as to have a bearing power smaller than the other drop-guard supporter.

When dust-collecting unit 4010A is removed from holding unit 4009A in the aforementioned structure, the right side of dust-collecting unit 4010A is subject to the engaging force of drop-guard supporter 4017 added to the engaging force of switch operation rib 4010A and switching unit 4008A, while the left side is subject to only the engaging force of drop-guard supporter 4017.

Drop-guard supporter 4017A has an engaging force smaller than that of drop-guard supporter 4017, thereby allowing dust-collecting unit 4010A to be held by substantially even force on the right and left. Therefore, dust-collecting unit 4010A can be smoothly pulled out without leftward tilting.

That is, dust-collecting unit 4010A has conventionally been kept unbalanced force between the right and the left since a contact resistance is greater on the side having switch operation rib 4011A for operating switching unit 4008A provided on holding unit 4009A, high-voltage power receiving terminal 4013A, and ground terminal 4012A than on the other side. Drop-guard supporter 4017A has a smaller bearing power, allowing the dust-collecting unit to be held by substantially even force on the right and left. With the structure, dust-collecting unit 4010A can be smoothly removed without torsion.

Drop-guard supporter 4017A has head 4002 and coil spring 4003A. Drop-guard supporter 4017A can have a bearing power smaller than that of drop-guard supporter 4017 by changing the number of turns, the diameter, or material of coil spring 4003A. That is, coil springs 4003 and 4003A may be difference in shape or material, allowing dust-collecting unit 4010A to be removed without torsion and simplifying the structure. The dimension of housing 4018 can be commonly between the two coil springs.

Exemplary Embodiment 12

Figure 46:
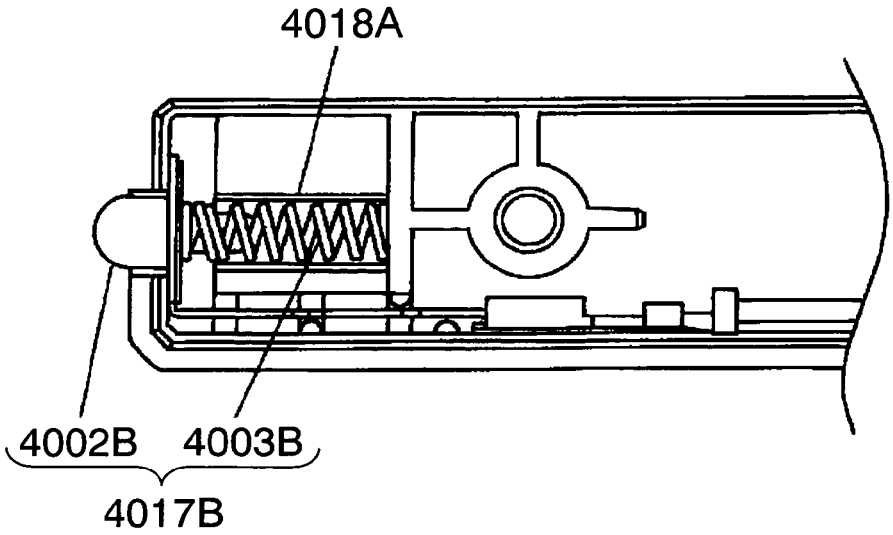
FIG. 46 is a partial view of an electric dust collector of Exemplary Embodiment 12 of the invention.
Figure 47:
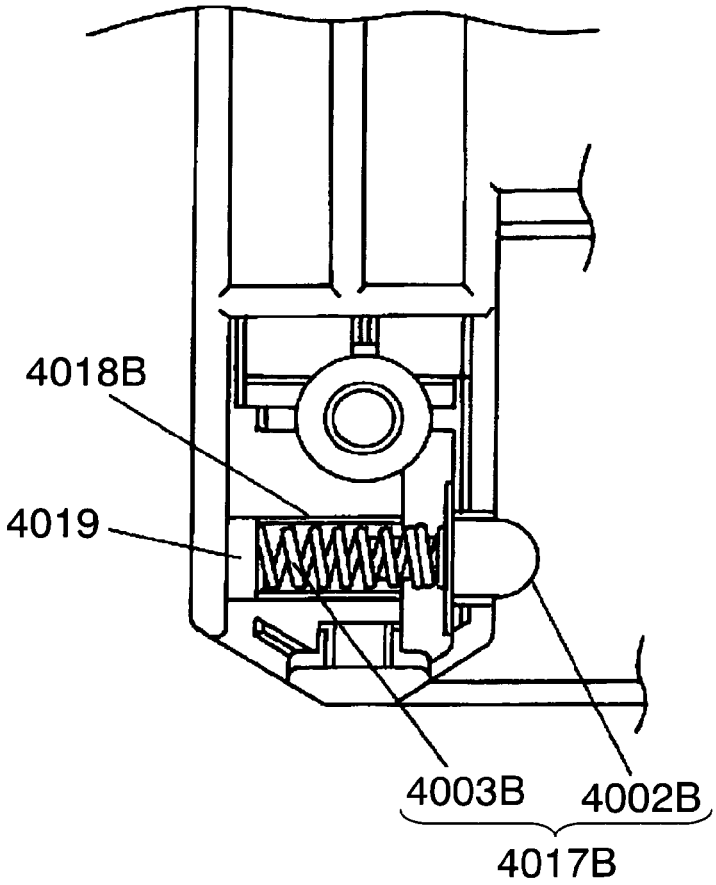
FIG. 47 is a partial view of the electric dust collector of Embodiment 12.

FIG. 46 is a partial view of an electric dust collector according to Exemplary Embodiment 12 of the present invention. FIG. 47 is a partial view of the electric dust collector of Embodiment 12.

As shown in FIG. 46 and FIG. 47, drop-guard supporter 4017B is formed as one-piece structure in a manner that head 4002B is integrally formed with an end of coil spring 4003B. Such structured drop-guard supporter 4017B is accommodated in housings 4018A and 4018B that are provided on the inner sides on the right and left of the holding unit (not shown). The structure of the embodiment employs housing 4018B having a size different from that of the other housing, by which different bearing power can be obtained between the right and left sides.

As an example of changing the size of housing 4018B, the embodiment introduces a structure having size-adjusting member 4019 on the bottom of housing 4018B. Member 4019 contracts coil spring 4003B by the length of member 4019, increasing the bearing power of head 4002B.

Drop-guard supporter 4017B is provided on the side opposite to drop-guard supporter 4017A, addressing the problem of unbalanced engaging force to the dust-collecting unit (not shown). Then, the dust-collecting unit can be smoothly pulled out without torsion. Coil spring 4003B can be employed for the structure above, contributing to standardization of components.

Exemplary Embodiment 13

Figure 48:
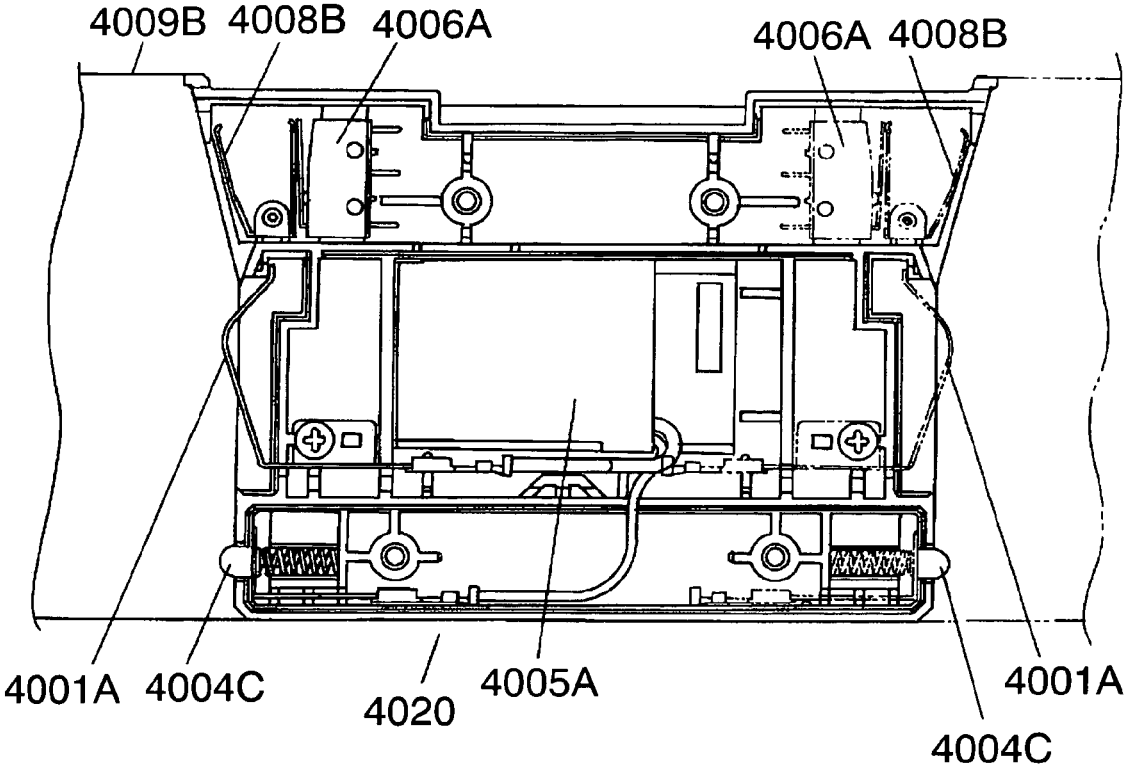
FIG. 48 is a front view of a high-voltage power supply unit of an electric dust collector of Exemplary Embodiment 13 of the invention.
Figure 49:
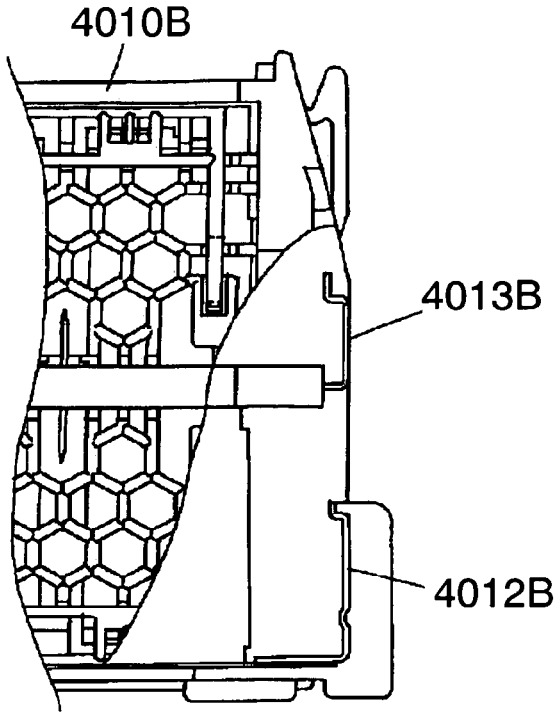
FIG. 49 is a partial view of the electric dust collector of Embodiment 13.
Figure 50:
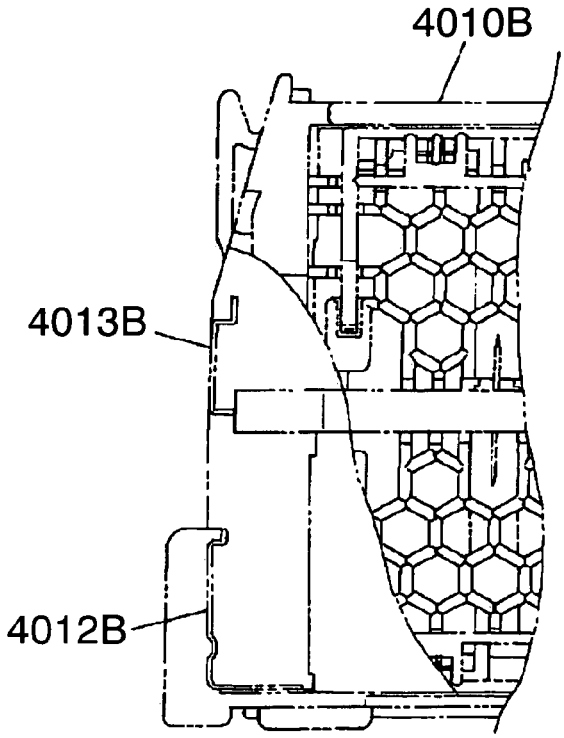
FIG. 50 is a partial view of the electric dust collector of Embodiment 13.

FIG. 48 is a front view of a high-voltage power supply unit of an electric dust collector according to Exemplary Embodiment 13 of the present invention. FIG. 49 is a partial view of the electric dust collector of Embodiment 13. FIG. 50 is a partial view of the electric dust collector of Embodiment 13.

As shown in FIG. 48 to FIG. 50, high-voltage power supply unit 4020 has high-voltage power supply 4005A having a shape mountable onto holding unit 4009B and having both sides substantially symmetrical to each other high-voltage power feeding terminal 4001A and ground connecting terminal 4004C are provided on both side surfaces of high-voltage power supply unit 4020 so that the dust-collecting unit can be attached to either side of high-voltage power supply unit 4020. The dust-collecting unit includes high-voltage power receiving terminal 4013B and ground terminal 4012B so as to correspond to high-voltage power feeding terminal 4001 A and ground terminal 4004C.

When dust-collecting unit 4010B is provided on the left side of high-voltage power supply unit 4020, limit switch 4006A for turning on and off high-voltage power supply 4005, switching unit 4008 for turning on and off limit switch 4006A, high-voltage power feeding terminal 4001A, and ground connecting terminal 4004C are provided on the left side of high-voltage power supply unit 4020. At the right side surface of dust-collecting unit 4010B, high-voltage power receiving terminal 4013B and ground terminal 4012B are provided on positions corresponding to high-voltage power feeding terminal 4001A and ground connecting terminal 4004C. On the other hand, when dust-collecting unit 4010B is provided on the right side of high-voltage power supply unit 4020, as indicated by the dash-double dot lines in the drawings, limit switch 4006A, switching unit 4008B, high-voltage power feeding terminal 4001A, and ground connecting terminal 4004C are provided on the right side of high-voltage power supply unit 4020. High-voltage power receiving terminal 4013B and ground terminal 4012B are provided on the left side of dust-collecting unit 4010B. With the structure above, regardless of the locations that high-voltage power supply unit 4020 is positioned on the right or the left of the holding unit, high-voltage power supply unit 4020 can be used commonly with differently structured dust-collecting unit, with minor replacement of parts.

Exemplary Embodiment 14

Figure 51A:
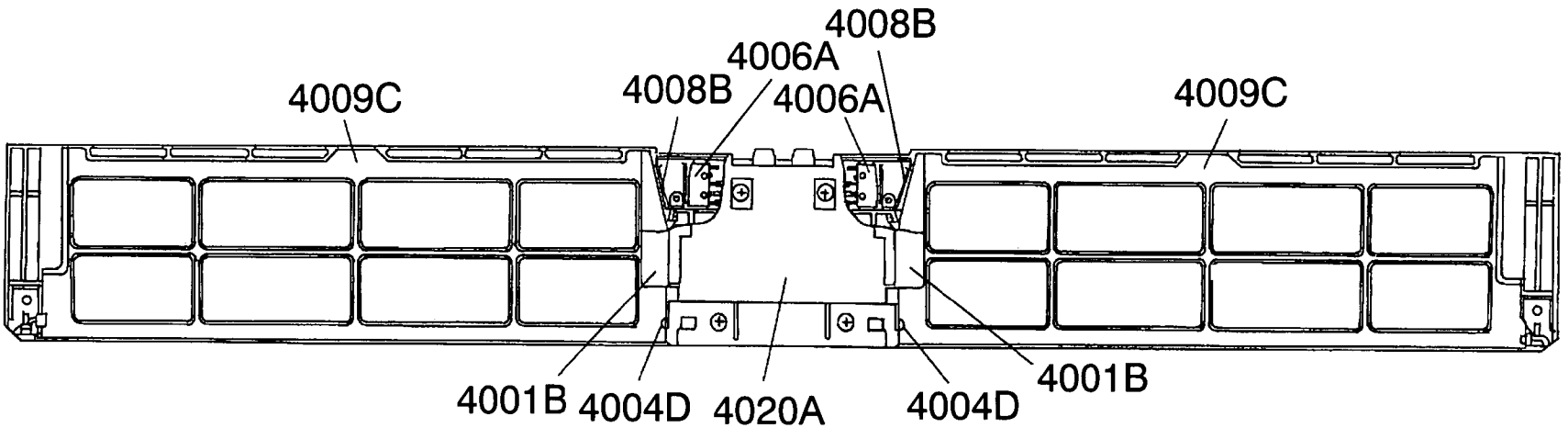
FIG. 51A is an exploded front view of an electric dust collector of Exemplary Embodiment 14 of the invention.
Figure 51C:
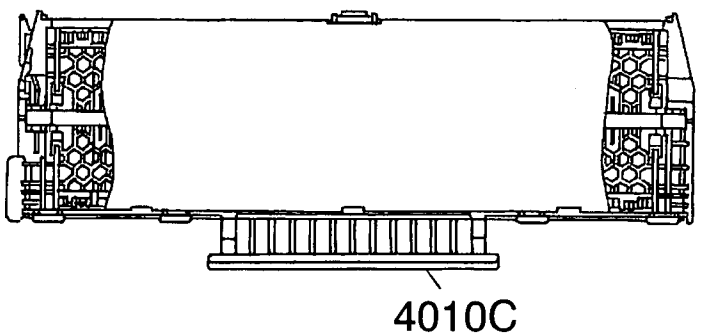
FIG. 51C is an exploded front view of the electric dust collector of Embodiment 14.
Figure 51B:
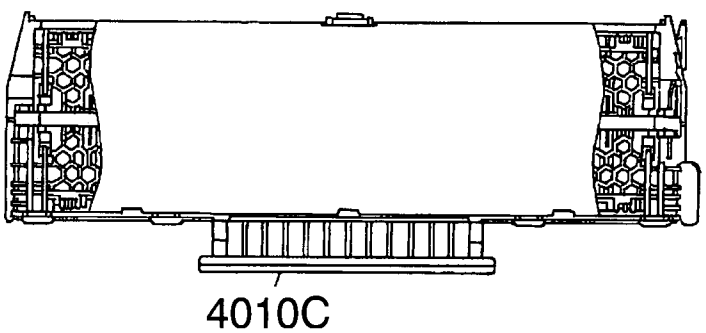
FIG. 51B is an exploded front view of the electric dust collector of the Embodiment 14.

FIG. 51A to FIG. 51C are exploded front views of an electric dust collector according to Exemplary Embodiment 14 of the present invention. Having both side surfaces having shapes substantially asymmetrical to each other, high-voltage power supply unit 4020A includes the high-voltage power supply (not shown), high-voltage power feeding terminal 4001B, and ground connecting terminal 4004D. Holding units 4009C on which dust-collecting units 4010C are mounted are provided on both side of high-voltage power supply unit 4020A.

In the structure above, each holding unit 4009C provided on both sides of high-voltage power supply unit 4020A has respective dust-collecting unit 4010C. The structure above allows components for home use to be expanded into the structure for business or industry use. This eliminates the need for producing another electric dust collector for business or industry use, contributing to low-cost production and simplified management of parts inventories.

Exemplary Embodiment 15

Figure 52A:
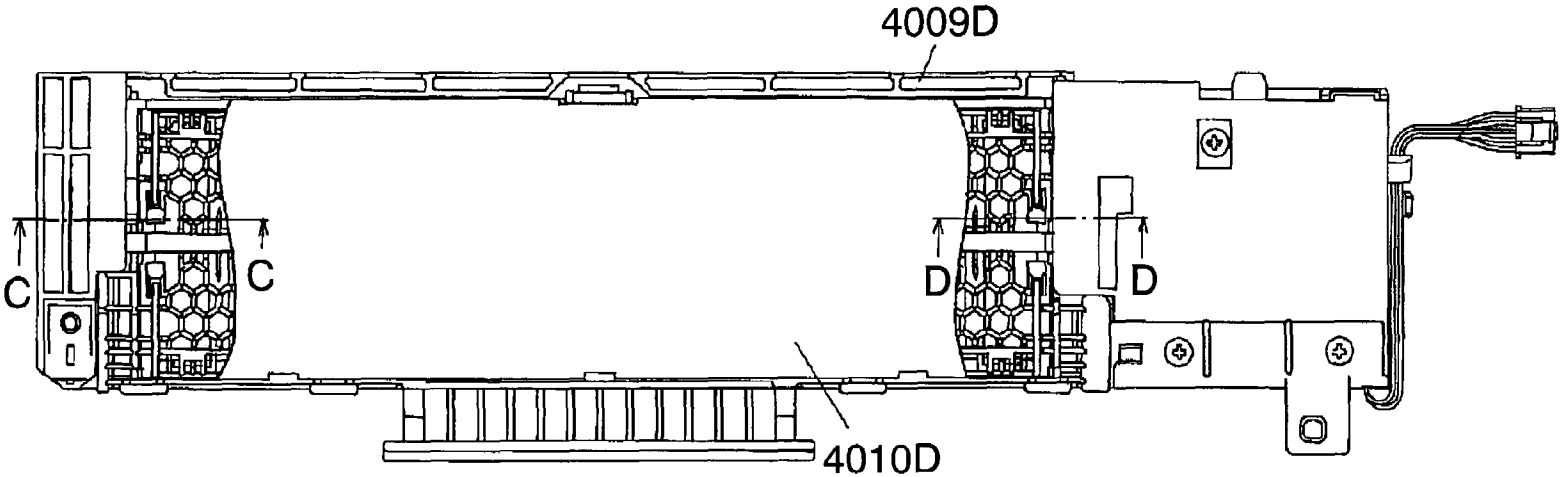
FIG. 52A is a front view of an electric dust collector of Exemplary Embodiment 15 of the invention.
Figure 52C:
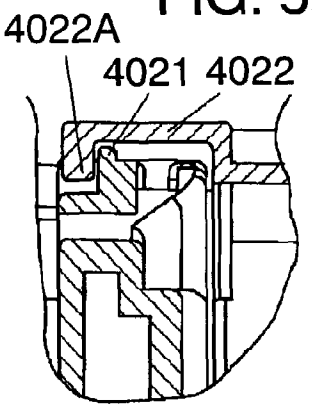
FIG. 52C is a section view of the electric dust collector at line 52C-52C shown in FIG. 52A.
Figure 52B:
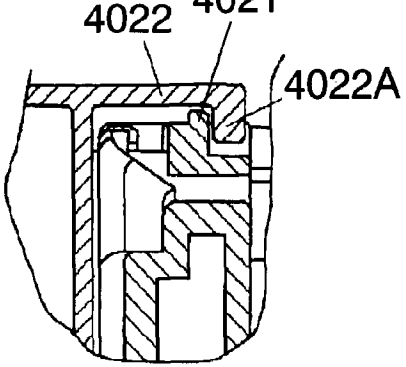
FIG. 52B is a section view of the electric dust collector at along line 52B-52B shown in FIG. 52A.
Figure 53:
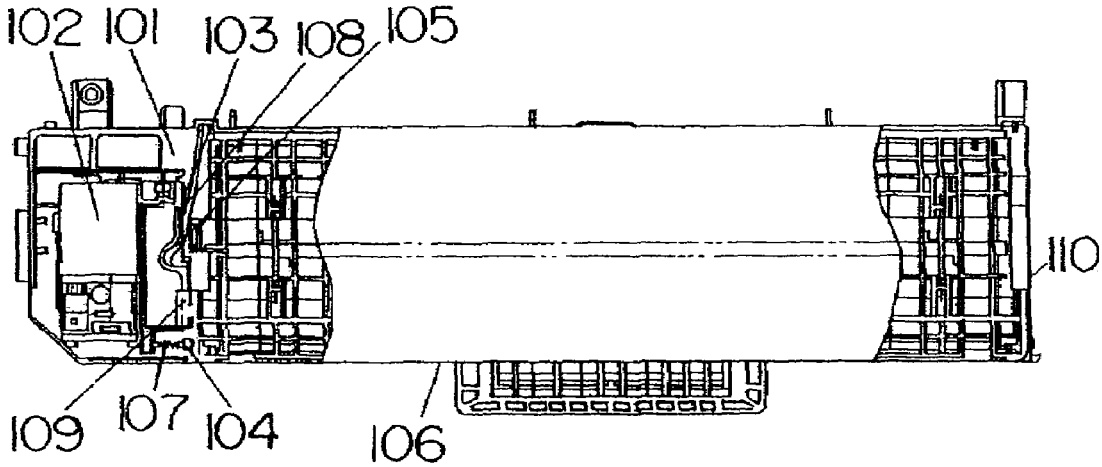
FIG. 53 PRIOR ART
FIG. 53 is a front view of a conventional electric air purifier.
Figure 54:
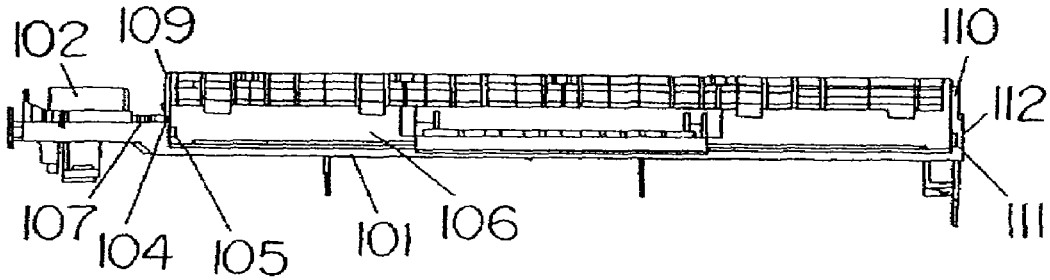
FIG. 54 PRIOR ART
FIG. 54 is a side view of the conventional electric air purifier.
Figure 55:
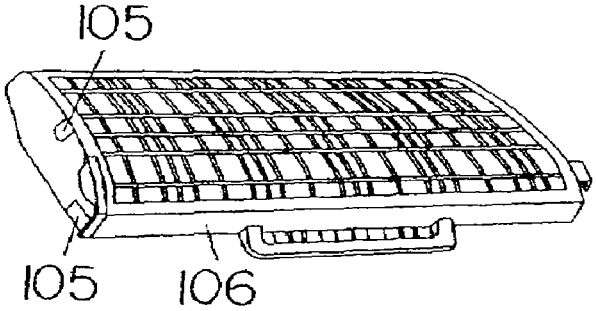
FIG. 55 PRIOR ART
FIG. 55 is a perspective view of a filter body of the conventional electric air purifier.
Figure 56:
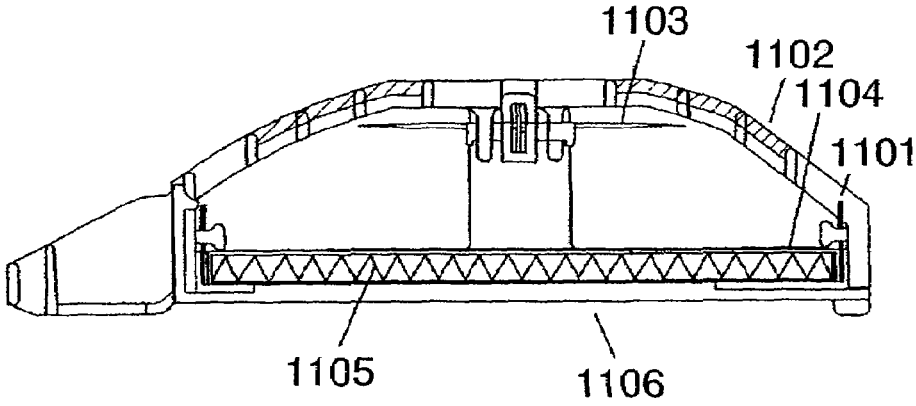
FIG. 56 PRIOR ART
FIG. 56 is a section view of a filter unit of a conventional electric dust-collecting unit for showing its structure.
Figure 57:
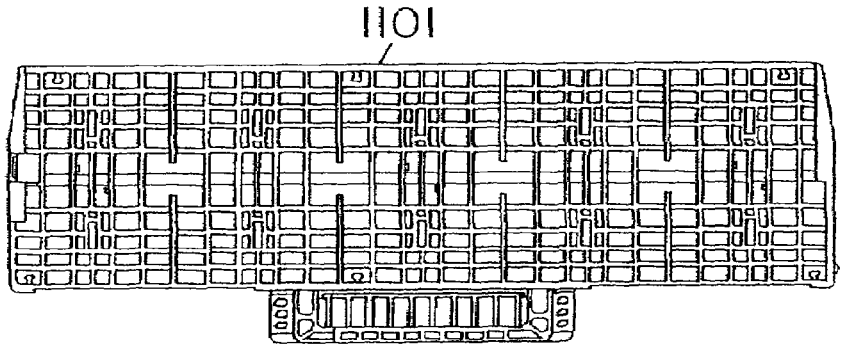
FIG. 57 PRIOR ART
FIG. 57 is a rear view of a filter frame of the conventional electric dust-collecting unit.
Figure 58:
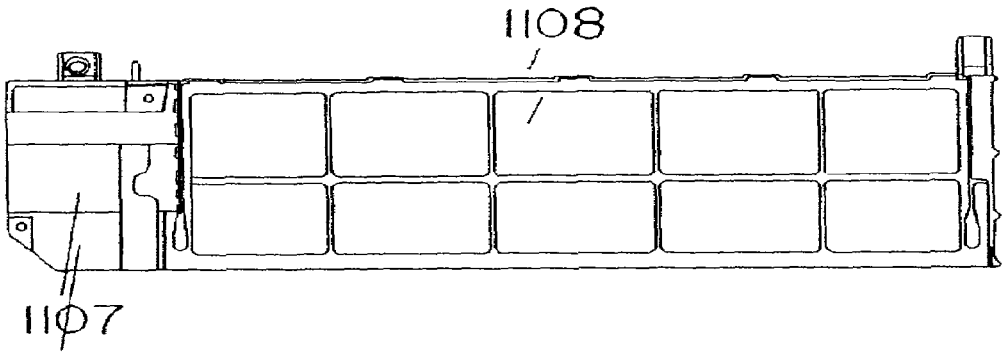
FIG. 58 PRIOR ART
FIG. 58 is a front view of the filter unit of the conventional electric dust-collecting unit.
Figure 59:
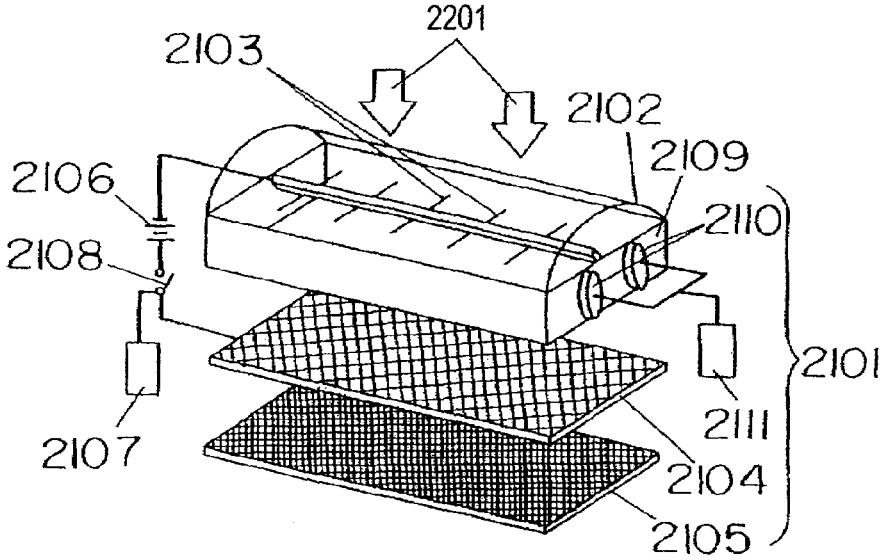
FIG. 59 PRIOR ART
FIG. 59 is an exploded perspective view of another conventional electric dust collector.
Figure 60:
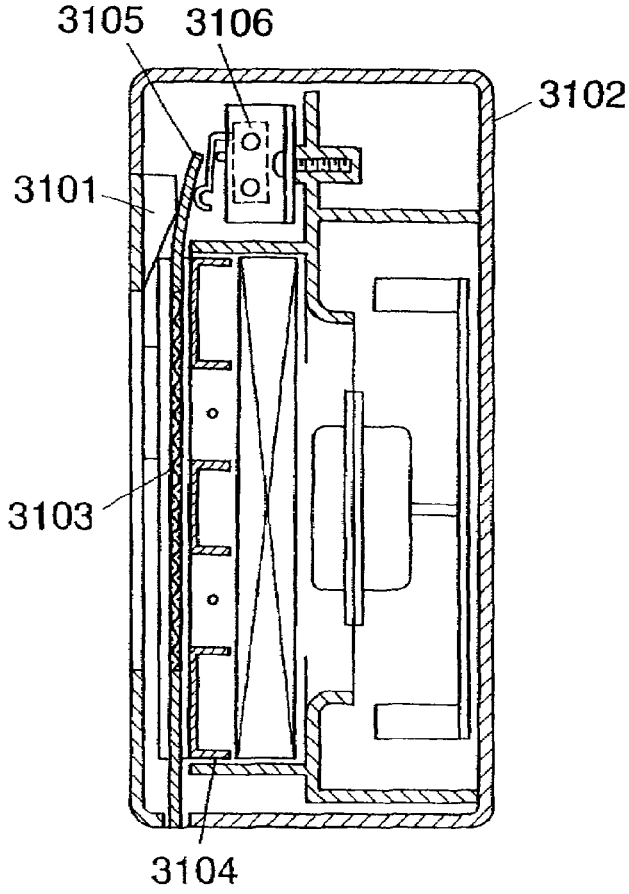
FIG. 60 PRIOR ART
FIG. 60 is a section view of a conventional air purifier.
Figure 61:
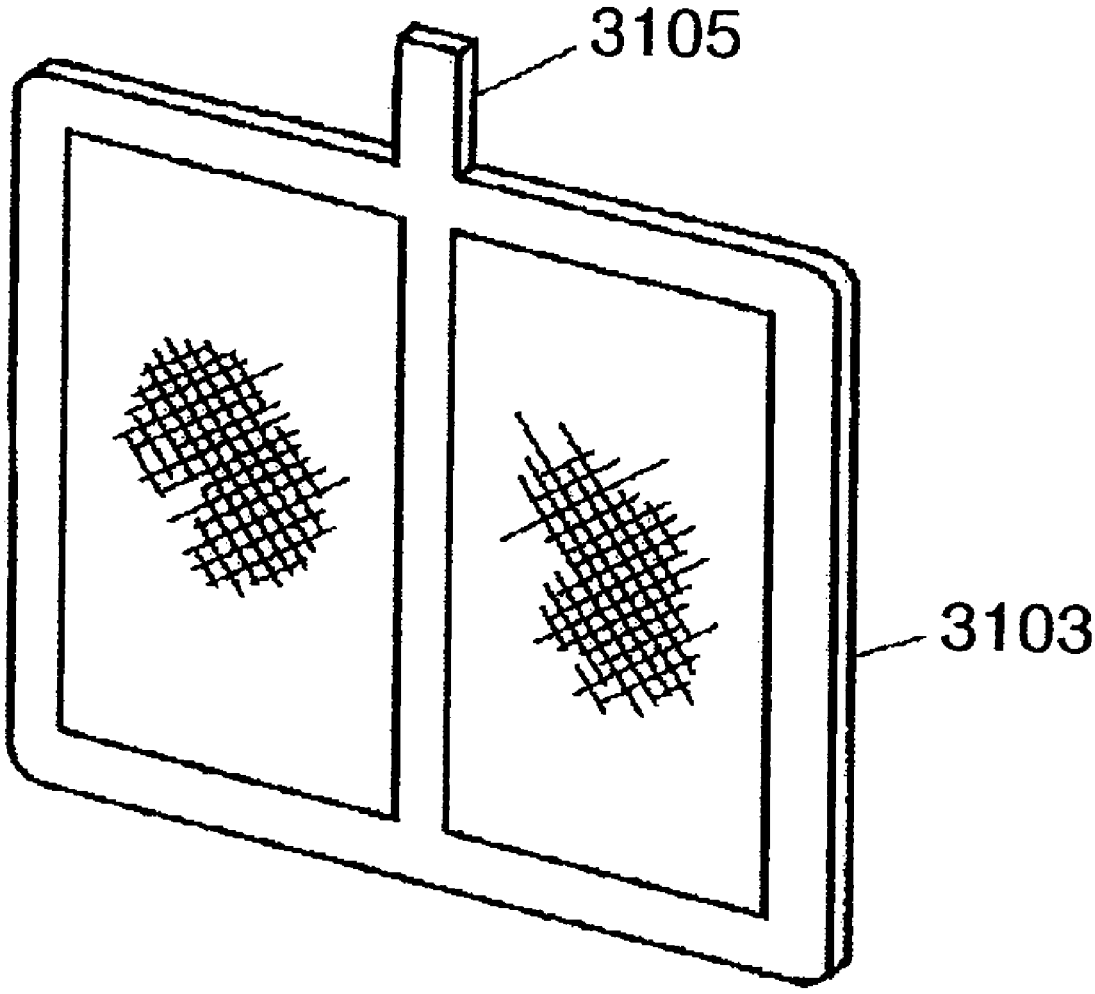
FIG. 61 PRIOR ART
FIG. 61 is a perspective view of a pre-filter of the conventional air purifier.
Figure 62:
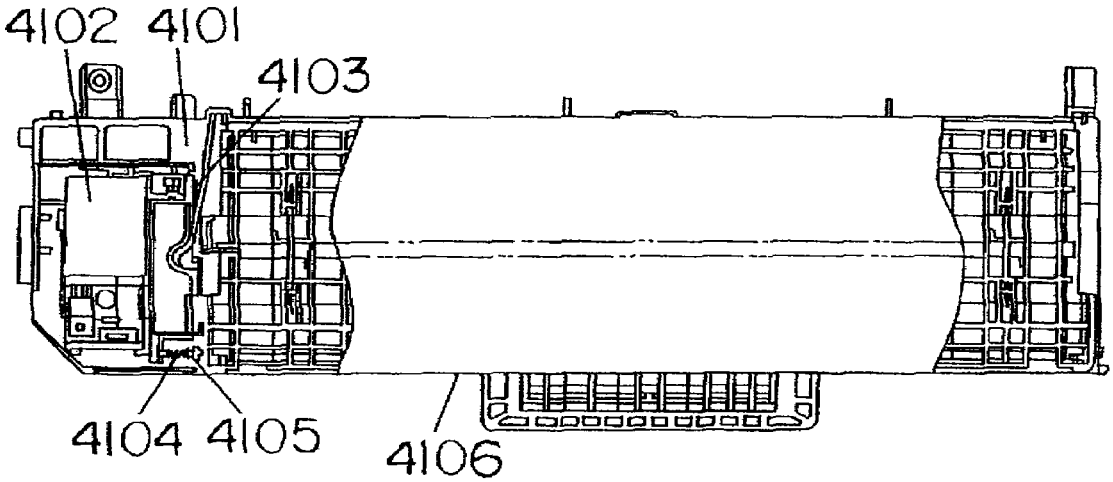
FIG. 62 PRIOR ART
FIG. 62 is a front view of another conventional electric dust collecting unit.

FIG. 52A is a front view of an electric dust collector according to Exemplary Embodiment 15 of the present invention. FIG. 52B is a section view of the electric dust collector at line 52B-52B shown in FIG. 52A. FIG. 52C is a section view of the electric dust collector at line 52C-52C shown in FIG. 52A.

As shown in FIG. 52A to FIG. 52C, a pair of rails are provided on both upper sides of dust-collecting unit 4010D so as to be parallel with each other Rails 4021 extend from each end to substantially the midpoint of dust-collecting unit 4010D. Holding unit 4009D on which dust-collecting unit 4010D is removably mounted has a pair of eaves 4022 at a position corresponding to rails 4021. The end of eaves 4022 is vertically bent to form bend 4022A.

When dust-collecting unit 4010D is pulled out from holding unit 4009, an engaging force from switch operation rib (not shown) and the switching unit (not shown) acts on the side having the switch operation rib, and therefore the side comes off first. This has often invited torsion. In the structure of the embodiment, however, rails 4021 of dust-collecting unit 4010D is guided by eaves 4022 of holding unit 4009D and smoothly pulled out forward with sliding movement. Also in attaching operation, positioning rails 4021 to eaves 4022 and pushing allows dust-collecting unit 4010D to easily fix on holding unit 4009D with very little resistance between the two units.

INDUSTRIAL APPLICABILITY

An electric dust collector according to the present invention can prevent a high-voltage power feeding terminal from dust collection. The collector prevents not only contact failure or electrical leak, but also protects hands or fingers from accidentally touching the high-voltage power feeding terminal, thereby increasing safety.

The invention claimed is:

1. An electric dust collector comprising:

an oblong holding unit mounted in an air channel of an air conditioner;

a high-voltage applying device provided at an end of the holding unit; and a filter unit removably provided on the holding unit, wherein the filter unit includes an air-intake grill having a shape having a center projecting to front, the air-intake grill having a first discharge needle electrically connected to the high-voltage applying device, an air-permeable ground electrode provided on a leeward side of the first discharge needle, and an air-permeable dust-collecting filter provided on a leeward side of the first discharge needle, and wherein the air-intake grill includes a non-conductive rib made of non-conductive resin, and a conductive rib that is provided in a lattice arrangement and is electrically connected to the ground electrode.

2. The electric dust collector of claim 1, wherein the first discharge needle has a tip surrounded by the conductive rib on a projection plane.

3. The electric dust collector of claim 2, wherein a shortest distance between the tip of the first discharge needle and the ground electrode is substantially identical to a shortest distance between the tip of the first discharge needle and the conductive rib of the air-intake grill.

4. The electric dust collector of claim 1, wherein a shortest distance between the tip of the first discharge needle and the ground electrode is substantially identical to a shortest distance between the tip of the first discharge needle and the conductive rib of the air-intake grill.

5. The electric dust collector of claim 1, further comprising:

a pawl provided at an end of the conductive rib of the air-intake grill; and an engaging section provided at the air-intake grill and having a caving shape, the engaging section being engaged with the pawl to fix the conductive rib.

6. The electric dust collector of claim 1, wherein the ground electrode has a frame made of metal at a perimeter thereof, said electric dust collector further comprising a connecting unit for connecting the frame of the ground electrode with the conductive rib of the air-intake grill at a plurality of positions, and wherein the connecting unit holds the non-conductive rib of the air-intake grill.

7. The electric dust collector of claim 1, further comprising a flat sub-electrode plate provided on the ground electrode at a shortest distance from the first discharge needle.

8. The electric dust collector of claim 1, wherein the ground electrode has a frame, said electric dust collector further comprising:

a dust-collecting filter accommodated in the frame of the ground electrode;

a burr produced on an outer side of the frame; and a filter unit frame for surrounding the filter unit through a clearance of the frame of the ground electrode, wherein a frame wall-height of the filter unit frame measured from the ground electrode as a reference plane is larger than a frame-height of the ground electrode, and wherein a thickness of the dust-collecting filter is larger than the frame-height of the ground electrode.

9. The electric dust collector of claim 1, further comprising an inflexible dust-collecting filter having an opening and accommodated in the ground electrode, wherein the filter unit includes a lattice-shaped filter frame for holding a side of the opening of the dust-collecting filter, and a small projection provided on the lattice of the filter frame and projecting toward the dust-collecting filter.

10. The electric dust collector of claim 1, further comprising:

a plurality of second discharge needles;

a needle-shaped electrode unit for connecting the second discharge needles to each other, wherein the air-intake grill has a front side having an oblong groove formed therein, and the needle-shaped electrode unit has a shape accommodated in the oblong groove:

a bend strip having an L-shape fitted in a slide projection provided on an edge of the filter unit, the bend strip serving as a high-voltage power receiving terminal of the needle-shaped electrode unit;

a needle-electrode cover for covering the needle-shaped electrode unit fitted in the groove; and a pressing rib provided at the needle-electrode cover, wherein, the needle-shaped electrode unit has a dent portion formed therein, and wherein the pressing rib contacts the dent portion of the needle-shaped electrode unit as to fix the needle-electrode cover.

* * * * *